United States Patent [19]

Tanaka et al.

[11] 4,259,439

[45] Mar. 31, 1981

[54] DIRECT POSITIVE SILVER HALIDE EMULSION

[75] Inventors: Akira Tanaka; Akio Yoshida; Kozo Haino, all of Nagaokakyo, Japan

[73] Assignee: Mitsubishi Paper Mills, Ltd., Tokyo, Japan

[21] Appl. No.: 952,214

[22] Filed: Oct. 17, 1978

[30] Foreign Application Priority Data

Oct. 28, 1977 [JP] Japan ..... 52-128715
Mar. 23, 1978 [JP] Japan ..... 53-33412
Jun. 1, 1978 [JP] Japan ..... 53-66245

[51] Int. Cl.[3] ..... G03C 1/08; G03C 1/36

[52] U.S. Cl. ..... 430/582; 430/581; 430/596; 430/597; 430/604; 430/605; 430/599; 542/434; 542/435; 542/467

[58] Field of Search ..... 96/130, 131, 101, 108, 96/136; 542/434, 435, 467; 430/596, 597, 581, 604, 605, 599, 587

[56] References Cited

U.S. PATENT DOCUMENTS 3,615,639 10/1971 Carpenter et al. ..... 96/130
3,925,085 12/1975 Sato et al. ..... 96/130

*Primary Examiner*—Won H. Louie, Jr.
*Attorney, Agent, or Firm*—Cushman, Darby & Cushman

[57] ABSTRACT

A high-contrast direct positive prefogged silver halide emulsion free from coror stain, which contains at least one new dimethinecyanine dye wherein the 3-position of a pyrazolo[1,5-a]pyridine nucleus is bonded through a dimethine chain to the 1-, 2-, 3- or 4-position of a cyanine hetero ring nucleus, provided that where the bonding is in the 4-position said cyanine nucleus is a quinoline nucleus or a pyridine nucleus and where the bonding is in the 1- or 3-position said cyanine nucleus is an isoquinoline nucleus, said dimethyinecyanine dye being present in an amount sufficient to sensitize said emulsion.

10 Claims, No Drawings

DIRECT POSITIVE SILVER HALIDE EMULSION

This invention relates to a direct positive silver halide photographic emulsion, and more particularly to a direct positive silver halide emulsion which is spectral sensitized by a novel dye containing a pyrazolo[1,5-a]pyridine ring.

Usually, a negative image is obtained when a silver halide photographic sensitive material is suitably exposed and developed. There is also known a so-called reversal development in which a positive image is obtained when a certain kind of silver halide sensitive material is exposed and developed. Such reversal development includes the Herschel effect, Villard effect and solarization. Of these techniques, solarization is employed for the high speed direct positive silver halide photograhic sensitive material. "Solarization" is a phenomenon that when a silver halide sensitive material is exposed to light including the light to which said material is sensitive and then developed, the blackening density, which has been increasing proportionally to the degree of exposure in the low exposure range, takes a downturn with further increase in the degree of exposure. Such polarization is also observed in the silver halide sensitive material which has been suitably fogged with light or by a chemical fogging agent.

This invention is intended to obtain a direct positive silver halide photographic emulsion with an excellent sensitization effect to the blue, green and red light by using a novel spectral sensitization dye.

There are known a variety of dyes usable for spectral sensitization of the ordinary types of negative emulsions, but when these dyes are used for spectral sensitization of the direct positive silver halide photographic emulsions, there arise many disadvantages, for example, the characteristic curve becomes low-contrast (that is, flattened) and there may take place a re-reversal phenomenon (that is, the photographic density, which has once dropped with increase of the amount of exposure, again assumes an upturn).

A lot of proposals have been made concerning the spectral sensitizers for the direct positive silver halide emulsions, but few of them are satisfactory in the degree of sensitization achieved. On the other hand, the dyes proposed in U.S. Pat. Nos. 3,314,796, 3,431,111 and 3,505,070 and Japanese Patent Publication No. 20727/72 are capable of achieving an excellent sensitization degree, but they have the drawback that coloring (color strain) could be caused by the residual dye after development.

As a result of extensive studies aimed at eliminating such defects and obtaining a direct positive sensitizing dye capable of providing a high degree of sensitization, the present inventors have succeeded in preparing a sensitizing dye which conforms to said end.

It is therefore an object of this invention to provide a high-sensitivity direct positive silver halide photographic emulsion by using a novel dimethinecyanine dye.

Another object of this invention is to provide a high-contrast direct positive silver halide emulsion by using a novel dimethinecyanine dye.

Still another object of this invention is to provide a direct positive silver halide emulsion which is free from coloring (color stain) by residual dye even when a novel dimethinecyanine dye is used.

The novel dye used in this invention is a dimethinecyanine dye containing a pyrazolo[1,5-a]pyridine ring.

More specifically, the present invention provides a direct positive silver halide emulsion containing at least one dimethinecyanine dye wherein the 3-position of a pyrazolo[1,5a]pyridine nucleus is connected to the 1-, 2-, 3- or 4-position of a cyanine hetero ring nucleus (provided that when the 4-position is the bonding position, the cyanine nucleus is a quinoline or a pyridine and when the 1- or 3-position is the bonding position, the cyanine nucleus is an isoquinoline) through a dimethine chain, and containing, if desired, an organic desensitizer.

The most preferred dimethinecyanine dyes for use in this invention are those represented by the following general formula:

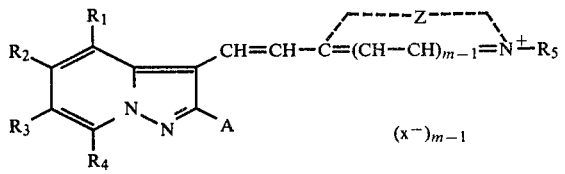

wherein $R_1$ to $R_4$ may be same or different and represent respectively hydrogen or an alkyl group, preferably a lower alkyl group with 1 to 5 carbon atoms (such as methyl, ethyl, propyl, butyl and amyl, etc. group), and the pyridine ring may be condensed with a benzene ring and the condensed benzene ring may be substituted with a lower alkyl group (such as above-mentioned), a lower alkoxy group (such as methoxy, ethoxy, propoxy, butoxy, etc.), or a halogen (such as fluorine, chlorine, bromine, iodine, etc.). $R_5$ represents an alky group (e.g. a lower alkyl group such as aforementioned, a hydroxyalkyl group such as β-hydroxyethyl or γ-hydroxypropyl, an acyloxyalkyl group such as β-acetoxyethyl, γ-acetoxypropyl or β-benzoyloxyethyl, an alkoxyalkyl group such as β-methoxyethyl, β-ethoxyethyl, β-isopropoxyethyl or β-(β-methoxyethoxy)ethyl, a carboxyalkyl group such as carboxymethyl, β-carboxyethyl, an alkoxycarbonylalkyl group such as methoxycarbonylmethyl, ethoxycarbonylmethyl or β-ethoxycarbonylethyl, a sulfoalkyl group such as β-sulfoethyl, γ-sulfopropyl or δ-sulfobutyl, and an aralkyl group such as benzyl or phenetyl), an alkenyl group (such as allyl) or an aryl group (such as phenyl). A represents a hydrogen atom, an aryl group [including those substituted with a lower alkyl group, a lower alkoxy group, a halogen atom, a cyano group, a nitro group, a hydroxy group, an acyloxy group (such as acetoxy, propionyloxy or benzoyloxy), a methylenedioxy group, an amino group, a lower dialkylamino group (such as acetoamide, propionamide, benzamide, phenylacetoamide, methanesulfonatmide, benzenesulfonamide or p-toluenesulfonamide) or other like groups], an alkyl group (including the substituted alkyl groups, e.g., a lower alkyl group such as aforementioned, a cycloalkyl group such as cyclopropyl or cyclohexyl, a benzyl group, a phenetyl group, a β-hydroxyethyl group, a β-ethoxyethyl group or a γ-phenoxypropyl group), or a 5- to 6-membered heterocyclic ring (e.g., a pyridine ring, quinoline ring, furan ring, thiophene ring, pyrrole ring, pyrrolidine ring, indole ring, oxazole ring, benzoxazole ring, thiazole ring or benzothiazole ring), Z represents the non-metallic atoms necessary for completing a 5- to 6-membered nitrogen containing heterocyclic ring well known in the cyanine dye chemistry such as for example an oxazoline ring, an oxazole ring (such as 4-methyloxyazole, 5-methyloxazole, 4-phenyloxazole, 5-phenyloxazole or 4,5-diphenyloxazole), a benzoxazole ring (such as benzoxazole, 5-fluorobenzoxazole, 5-chlorobenzoxazole, 5-methylbenzoxazole, 5-phenylbenzoxazole, 5,6-dimethylbenzoxazole, 5-methoxybenzoxazole, 5-ethoxybenzoxazole, 6-methoxybenzoxazole, 5-acetylbenzoxazole, 5-benzoylbenzoxazole, 5-chloro-6-methylbenzoxazole, 5-carboxybenzoxazole, 5-methyoxycarbonylbenzoxazole, 5-nitrobenzoxazole, 6-nitrobenzoxazole, 5-chloro-6-nitrobenzoxazole, 5-hydroxybenzoxazole or 6-hydroxybenzoxazole), a naphthoxazole ring (such as α-naphthoxazole, β-naphthoxazole, or β, β-naphthoxazole), an oxazolo[4,5-b]pyridine ring, a thiazoline ring (such as thiazoline or 5-methylthiazoline), a thiazole ring (such as thiazole, 4-methylthiazole, 4-phenylthiazole, 5-methylthiazole, 5-phenylthiazole, 4,5-dimethylthiazole or 4,5-diphenylthiazole), a benzothiazole ring (such as benzothiazole, 4-chlorobenzothiazole, 5-chlorobenzothiazole, 6-chlorobenzothiazole, 7-chlorobenzothiazole, 5-methylbenzothiazole, 6-methylbenzothiazole, 5,6-dimethylbenzothiazole, 5-bromobenzothiazole, 6-bromobenzothiazole, 5-phenylbenzothiazole, 4-methoxybenzothiazole, 5-methoxybenzothiazole, 6-methoxybenzothiazole, 5-iodobenzothiazole, 6- iodobenzothiazole, 5-methoxycarbonylbenzothiazole, 5-ethoxybenzothiazole, tetrahydrobenzothiazole, 5-N,N-dimethylaminobenzothiazole, 5,6-dimethoxybenzothiazole, 5-hydroxybenzothiazole, 6-hydroxybenzothiazole, 5-carboxybenzothiazole, 5-nitrobenzothiazole, 6-nitrobenzothiazole, 5-chloro-6-nitrobenzothiazole, or 5,6-methylenedioxybenzothiazole), a naphthothiazole ring (such as α-naphthothiazole, β-naphthothiazole, 8-methoxy-α-napthhothiazole, 7-methoxy-α-naphthothiazole, 5-methoxy-β-naphthothiazole, or 5-ethoxy-β-naphthothiazole), a 1,3,4-thiadiazole ring (such as 2-methyl-1,3,4-thiadiazole, or 2-phenyl-1,3,4-thiadiazole), a selenazole ring (such as 4-methylselenazole or 4-phenyl selenazole), a benzoselenazole ring (such as benzselenazole, 5-chlorobenzselenazole, 5-methoxybenzselenazole, 6-ethoxybenzselenazole, 5-hydroxybenzselenazole, or tetrahydrobenzselenazole), a naphthoselenazole ring (such as α-naphthoselenazole or β-naphthoselenazole), a 2-pyridine ring (such as pyridine, 3-methylpyridine, 4-methylpyridine, 5-methylpyridine, 5-ethylpyridine or 3,4-dimethylpyridine), a 4-pyridine ring (such as pyridine, 2-methylpyridine or 2,6-dimethylpyridine), a 2-quinoline ring (such as quinoline, 3-methylquinoline, 5-methylquinoline, 6-methylquinoline, 7-methylquinoline, 8-methylquinoline, 6-chloroquinoline, 8-chloroquinoline, 6-methoxyquinoline, 6-ethoxyquinoline, 6-hydroxyquinoline, 8-hydroxyquinoline, or benzo[f]quinoline), a 4-quinoline ring (such as quinoline, 6-methoxyquinoline, 7-methylquinoline, or 8-methylquinoline), a thiazolo[4,5-b]quinoline ring, a 9-acridine ring, a 1-isoquinoline ring (such as isoquinoline, or 3,4-dihydroisoquinoline), a 3-isoquinoline ring (such as isoquinoline, 1-methylisoquinoline, 5-methylisoquinoline, 6-chloroisoquinoline, 6-methoxyisoquinoline, or 8-methoxyisoquinoline), an imidazole ring (such as 1-methylimidazole, 1-ethyl-4-phenylimidazole, or 1-butyl-4,5-dimethylimidazole ring), a benzimidazole ring (such as 1-methylbenimidazole, 1-ethyl-4-methylbenzimidazole, or 1-ethyl-4,5-dichlorobenzimidazole), a naphthoimidazole ring (such as 1-methyl-α-naphthoimidazole or 1-ethyl-β-naphthoimidazole), an indolenine ring (such as 3,3-dimethylindolenine, 3,3,5-trimethylindolenine, 3,3,7-trimethylindolenine, 5-hydroxy-3,3-dimethylindolenine, 6-chloro-3,3-dimethylindolenine, or 3,3-dimethyl-5-nitroindolenine), an imidazo[4,5-b]quinoxaline ring (such as 1-ethylimidazo[4,5-b]quinoxaline, 1-ethyl-6-nitroimidazo[4,5-b]quinoxaline, 1-phenylimidazo[4,5-b]quinoxaline, 6-chloro-1-phenylimidazo[4,5-b]quinoxaline, or 1-allylimidazo[4,5-b]quinoxaline), a 2-naphthyridine(1,8) ring (such as 1,8-naphthyridine, 4-methyl-1,8-naphthyridine, 6-methyl-1,8-naphthyridine, or 7-methyl-1,8-naphthyridine), a 4-naphthyridine(1,8) ring (such as 1,8-naphthyridine, 2-methyl-1,8-naphthyridine, 5-methyl-1,8-naphthyridine, 6-methyl-1,8-naphthyridine, or 2,7-dimethyl-1,8-naphthyridine), or a pyrroline ring. $X^-$ represents an acid anion (such as methylsulfate ion, ethylsulfate ion, thiocyanate ion, p-toluenesulfonic acid ion, chloride ion, bromide ion, iodide ion, or perchlorate ion), and m and n represent a number of 1 or 2.

Listed below are the preferred examples of the dyes usable in this invention. The numerical values in the parentheses show the absorption maximum (mn) in a methanol solution.

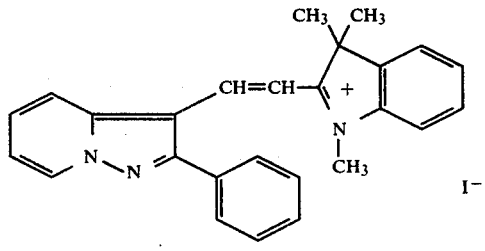

(1)

(478)

-continued
(2)
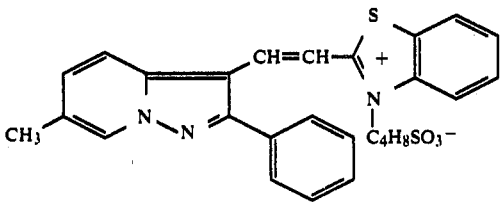
(490)
(3)
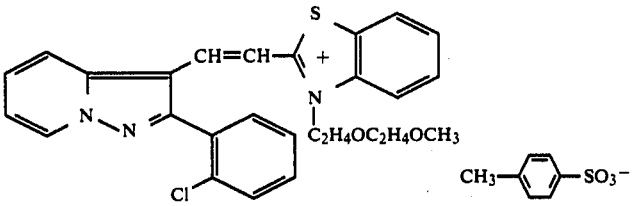
(460)
(4)
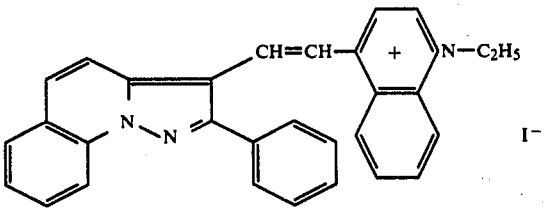
(465)
(5)
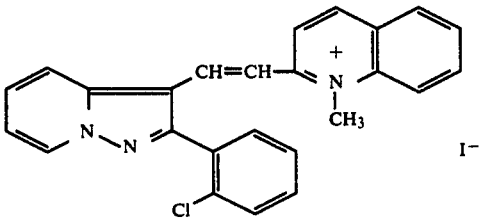
(465)
(6)
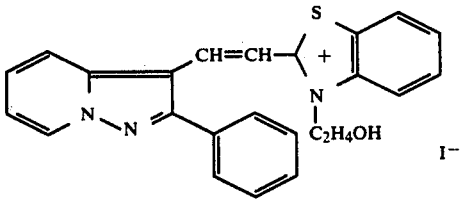
(467)
(7)
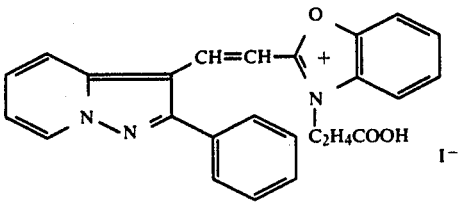
(441, 460)

-continued
(8)
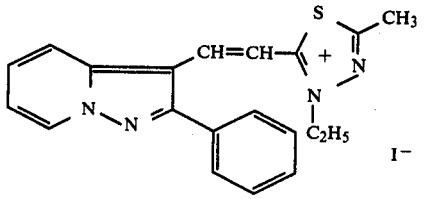
(443)
(9)
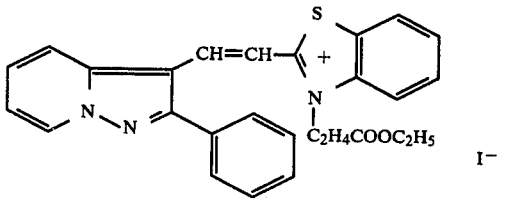
(468)
(10)
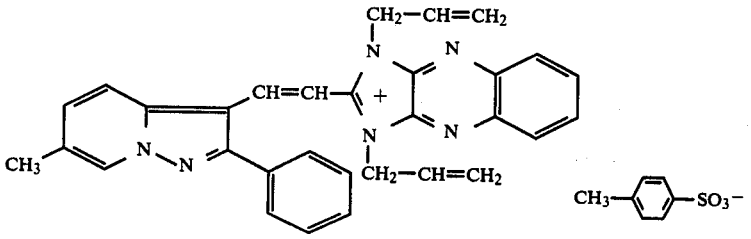
(505)
(11)
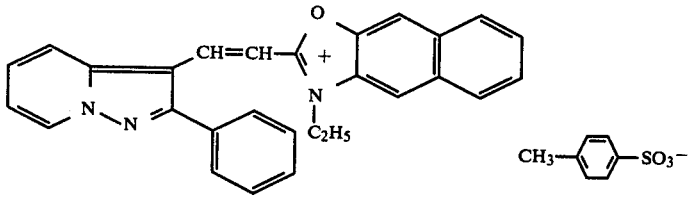
(460, 476)
(12)
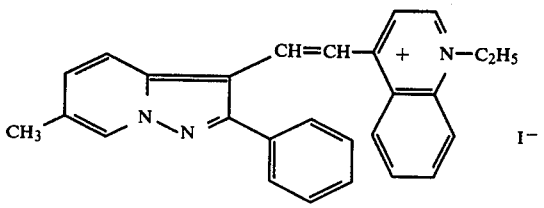
(495)
(13)
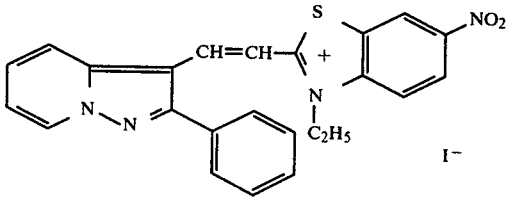
(504)

-continued
(14)
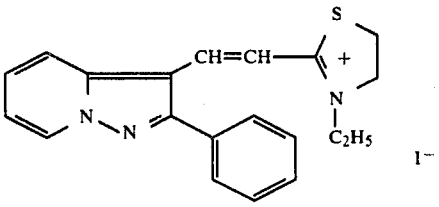
(433)
(15)
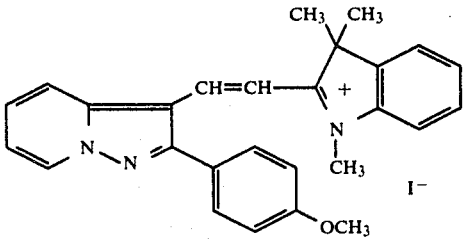
(482, 499)
(16)
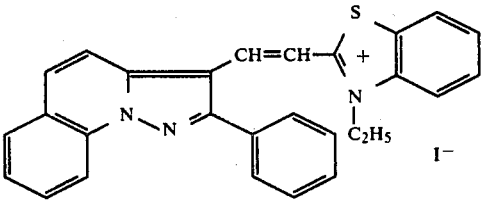
(458)
(17)
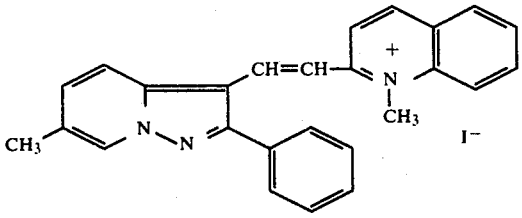
(480)
(18)
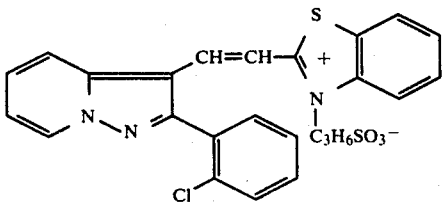
(467)
(19)
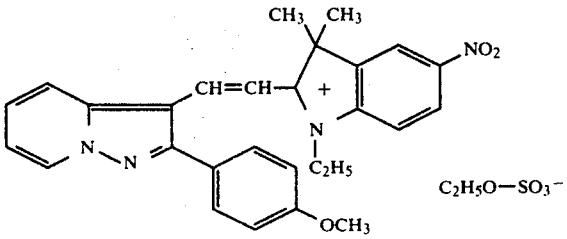
(523)

-continued
(20)
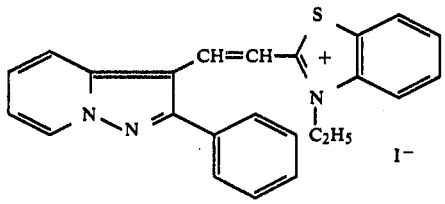
(465)
(21)
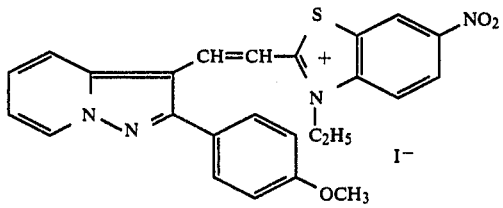
(510)
(22)
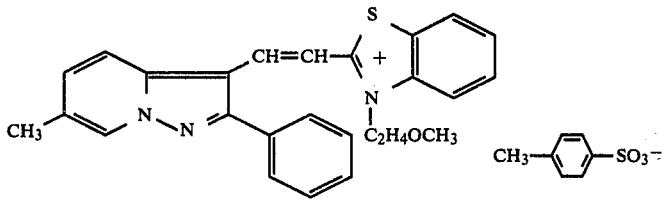
(478)
(23)
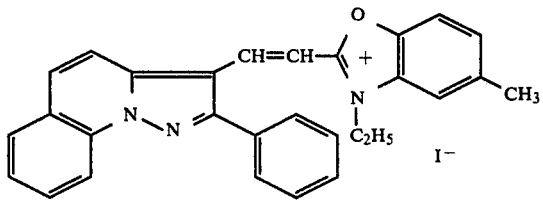
(440)
(24)
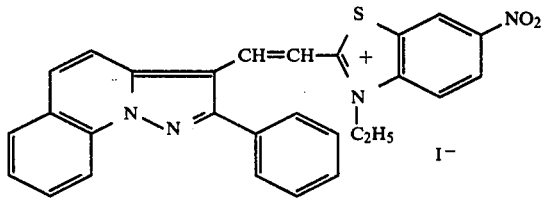
(495)
(25)
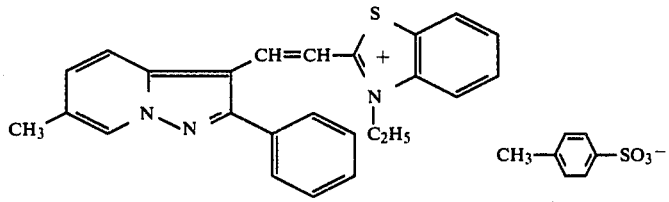
(480)

-continued
(26)
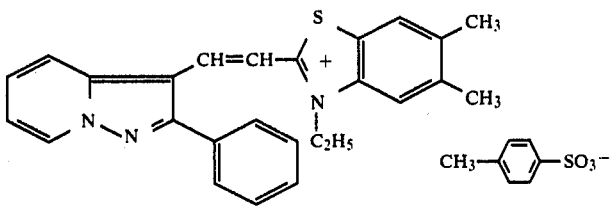
(466)
(27)
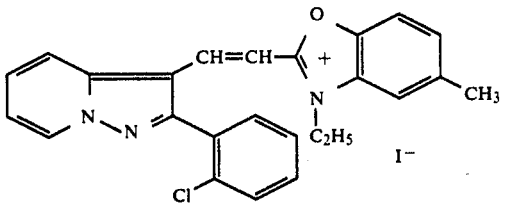
(436)
(28)
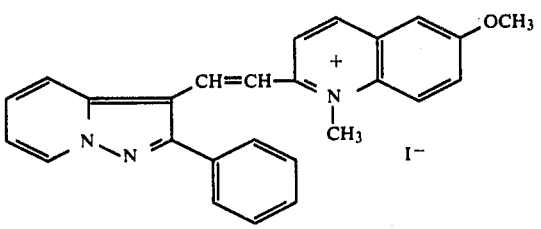
(460)
(29)
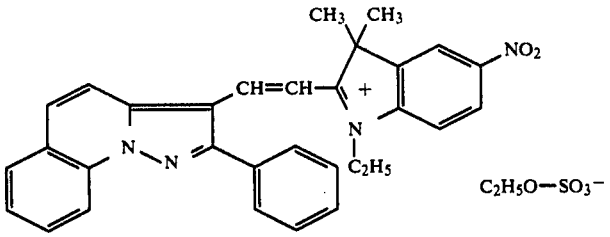
(521)
(30)
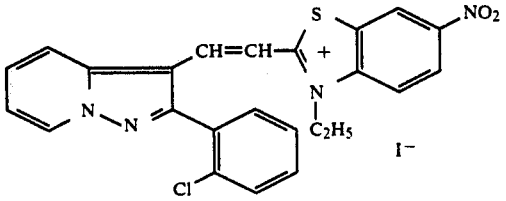
(500)
(31)
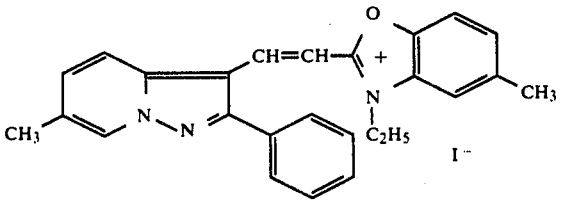
(455)

-continued
(32)
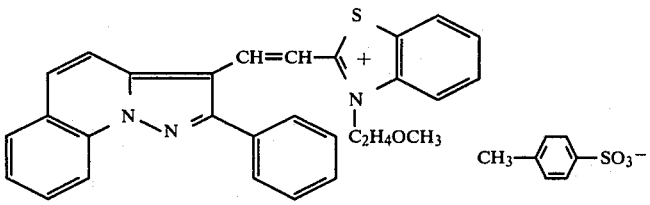
(457)
(33)
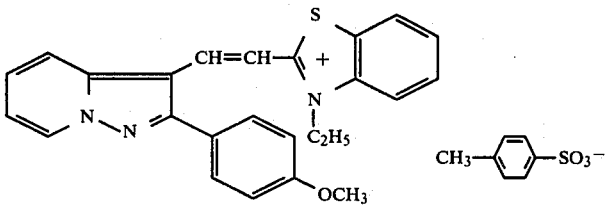
(476)
(34)
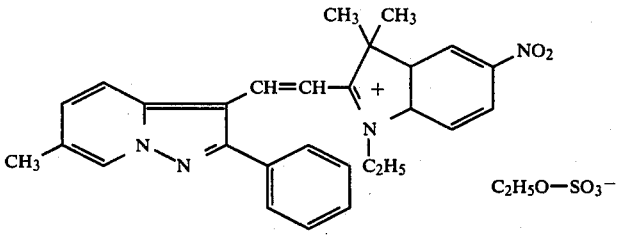
(524)
(35)
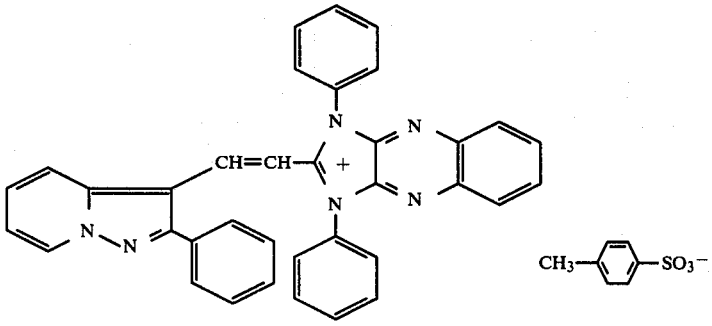
(507)
(36)
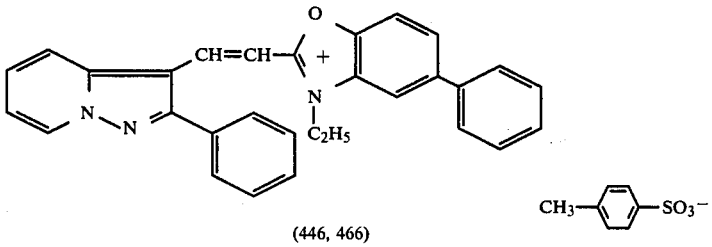
(446, 466)
(37)
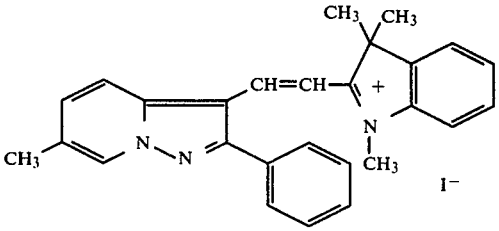
(492)

-continued
(38)
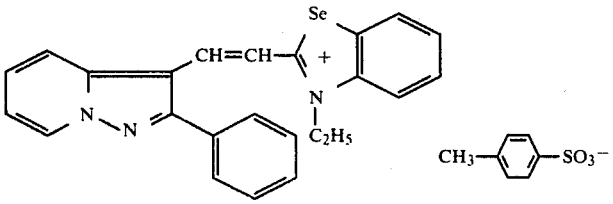
(480)
(39)
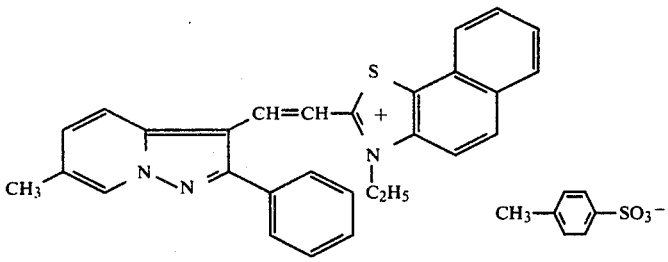
(470)
(40)
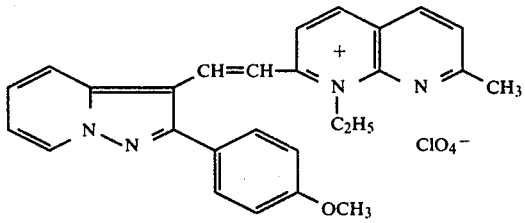
(494)
(41)
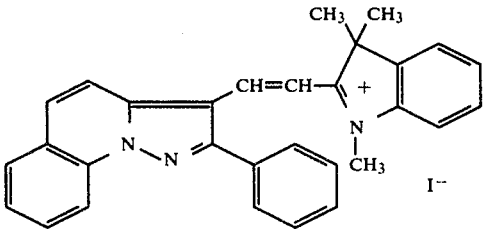
(477)
(42)
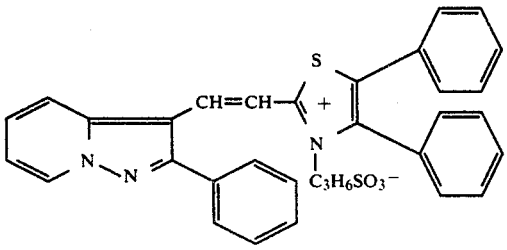
(462)
(43)
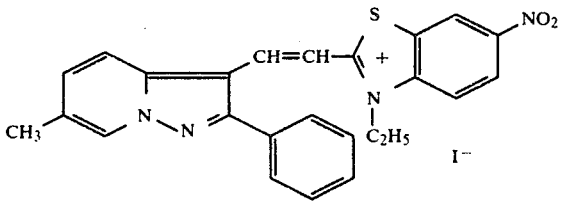
(513)

-continued
(44)
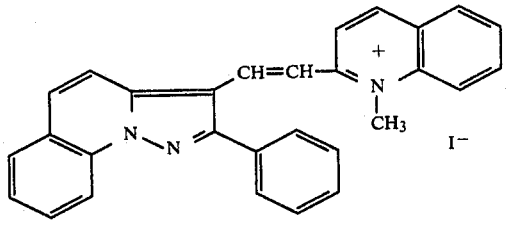
(452)
(45)
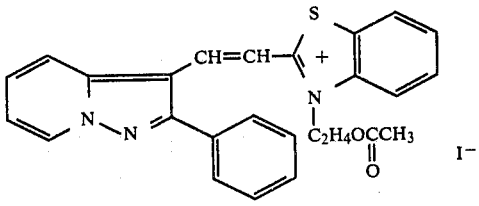
(478)
(46)
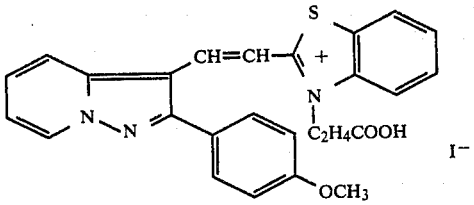
(480)
(47)
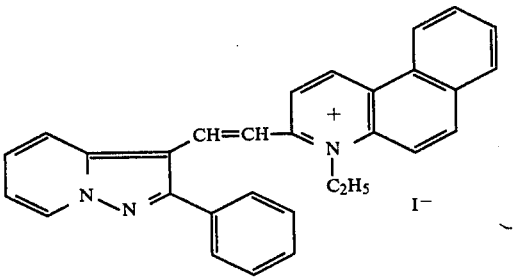
(462)
(48)
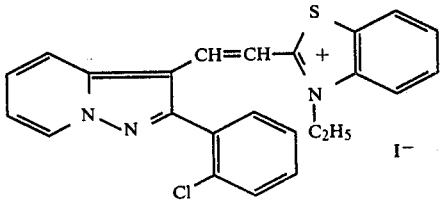
(463)
(49)
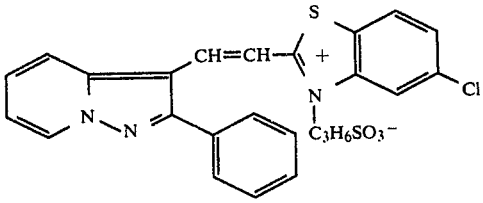
(493)

-continued
(50)
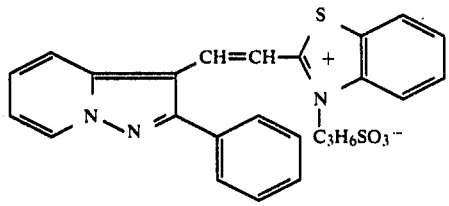
(478)
(51)
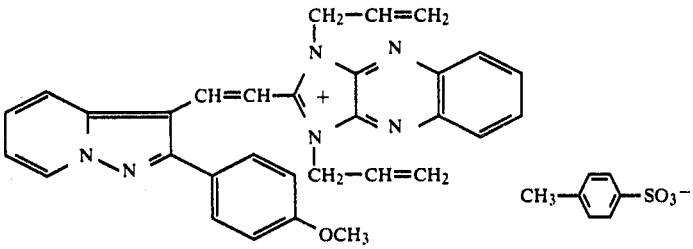
(502)
(52)
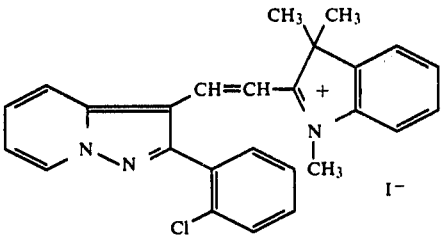
(475)
(53)
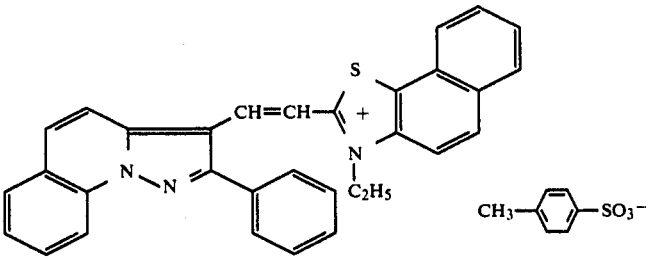
(468)
(54)
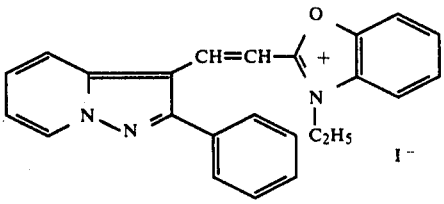
(458)
(55)
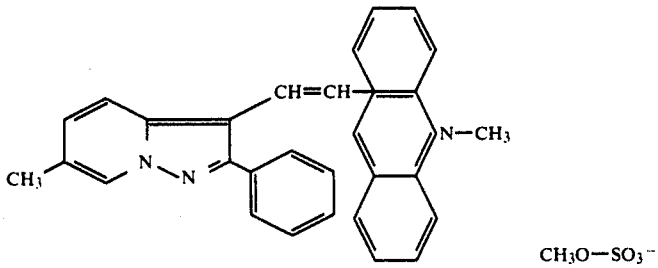
(575)

-continued
(56)
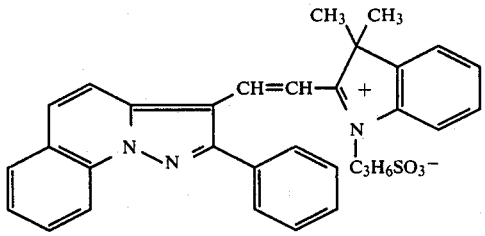
(482, 510)
(57)
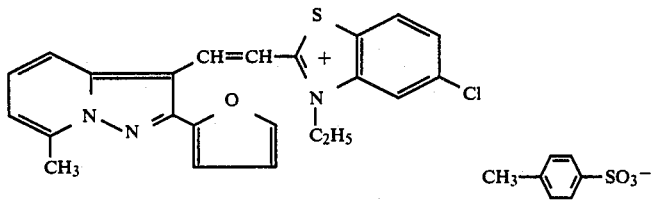
(503)
(58)
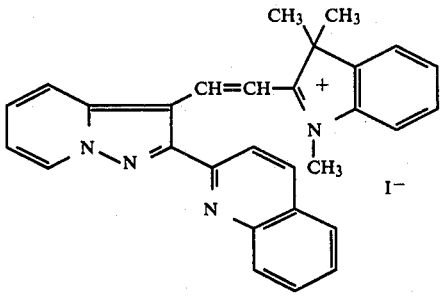
(482)
(59)
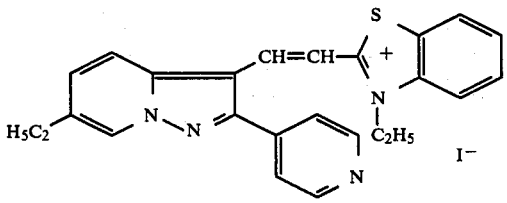
(468)
(60)
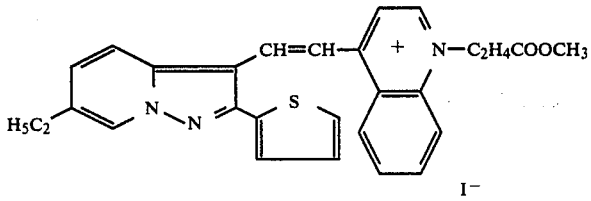
(487)
(61)
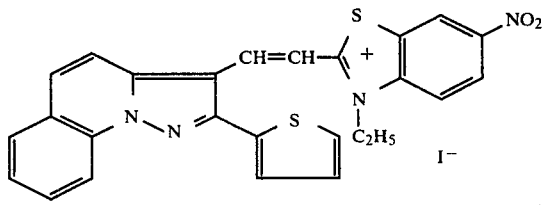
(498)

-continued
(62)
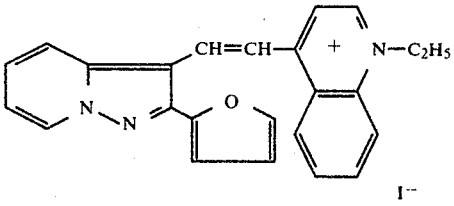
(488)
(63)
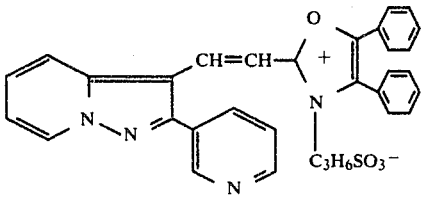
(432)
(64)
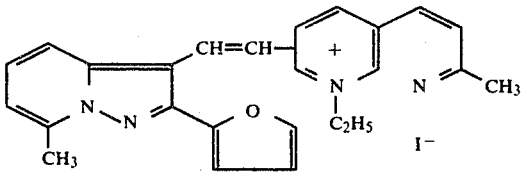
(505)
(65)
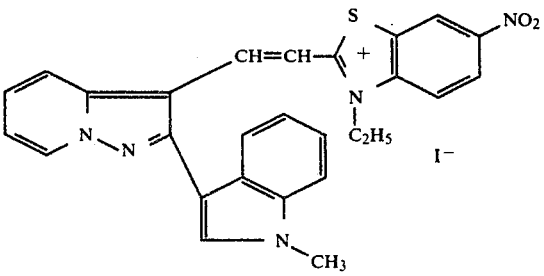
(521)
(66)
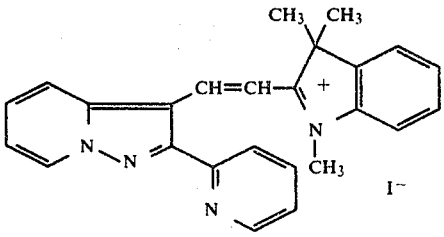
(476, 495)
(67)
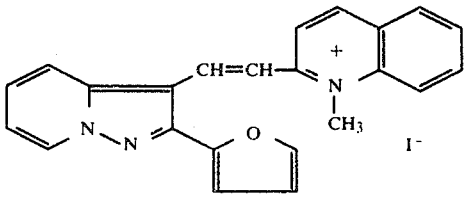
(472)

-continued
(68)
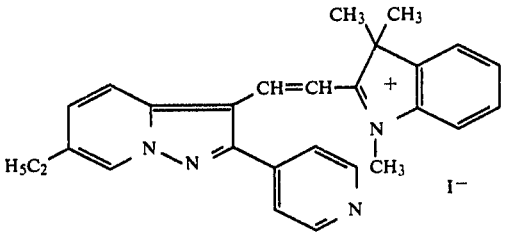
(480)
(69)
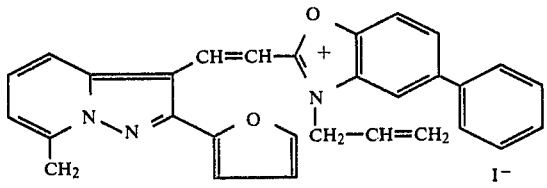
(483)
(70)
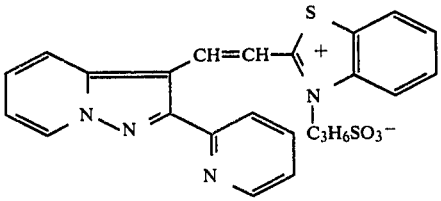
(470)
(71)
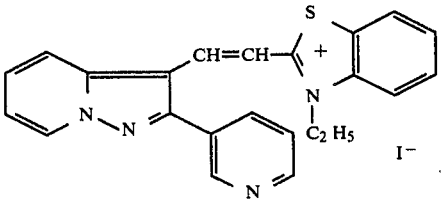
(461)
(72)
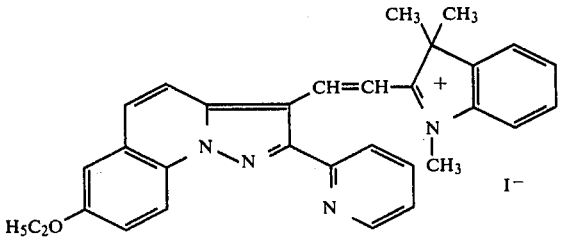
(483, 505)
(73)
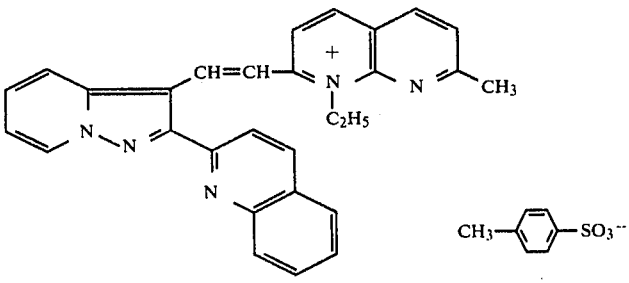
(485)

-continued
(74)
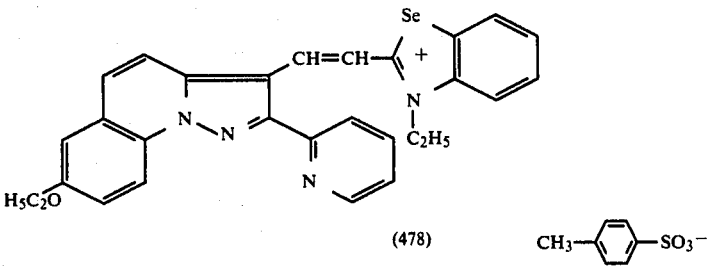
(478)
(75)
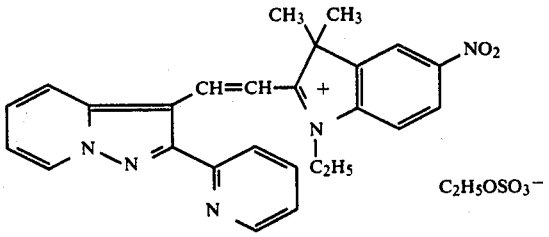
(495, 519)
(76)
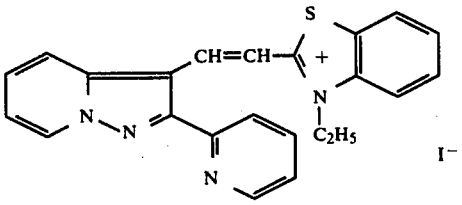
(465)
(77)
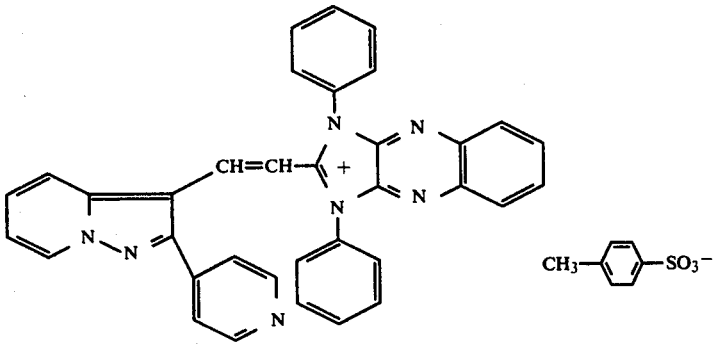
(501)
(78)
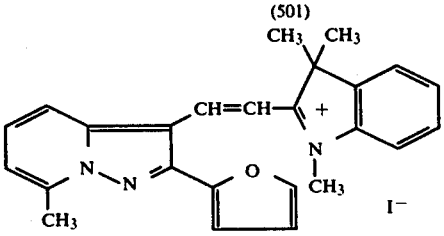
(495, 518)
(79)
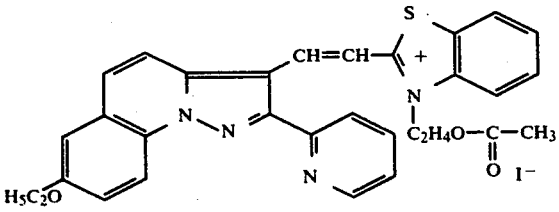
(475)

-continued
(80)
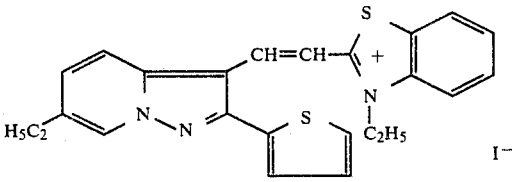
(485)
(81)
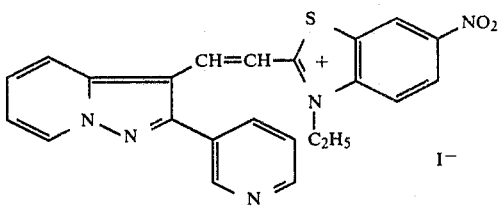
(500)
(82)
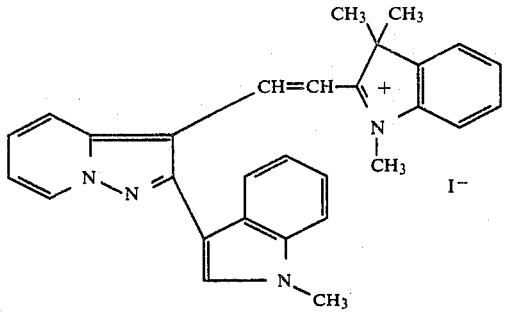
(506)
(83)
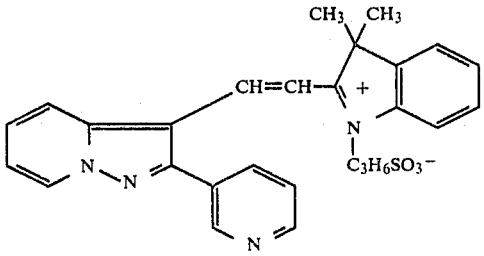
(481, 500)
(84)
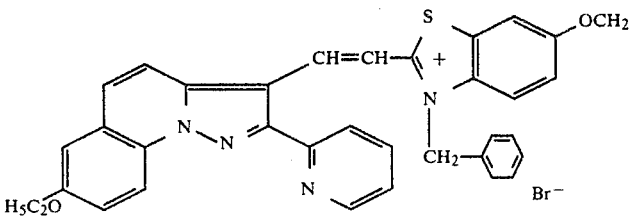
(480)
(85)
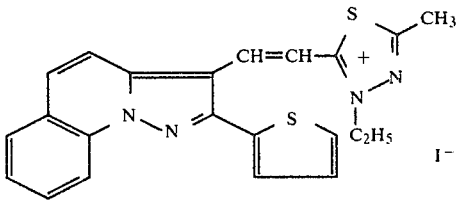
(439)

-continued
(86)
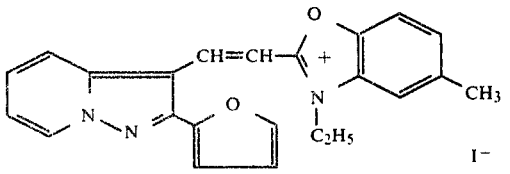
(445, 470)
(87)
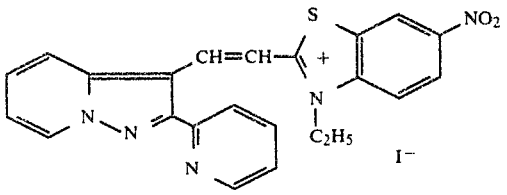
(505)
(88)
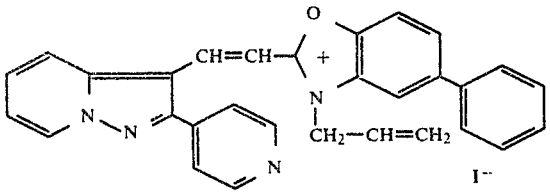
(445, 465)
(89)
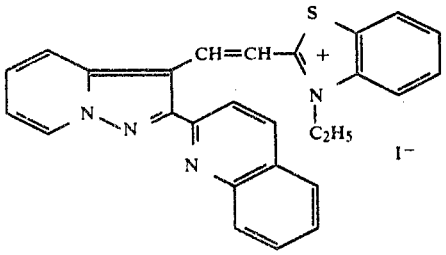
(470)
(90)
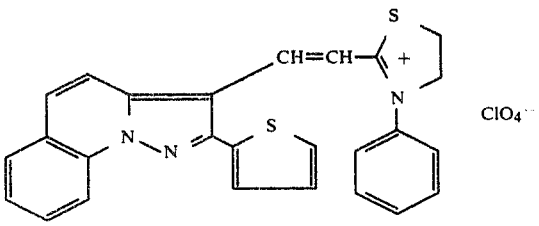
(450)
(91)
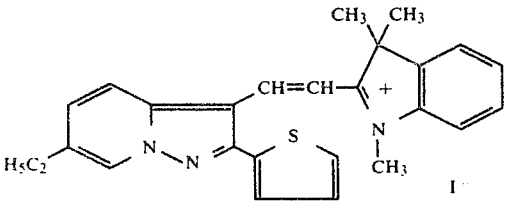
(491, 505)

-continued
(92)
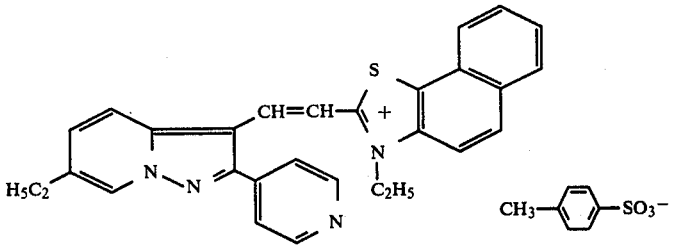
(477)
(93)
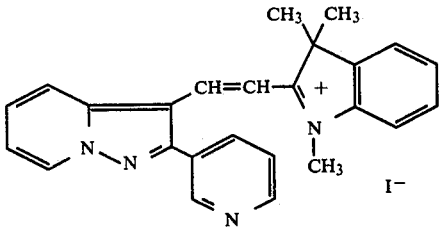
(475)
(94)
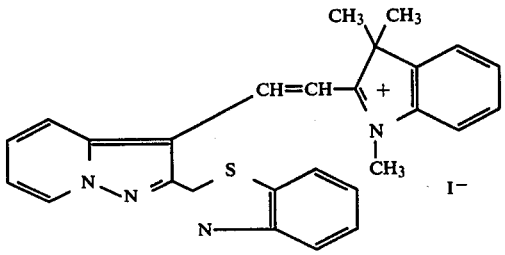
(480)
(95)
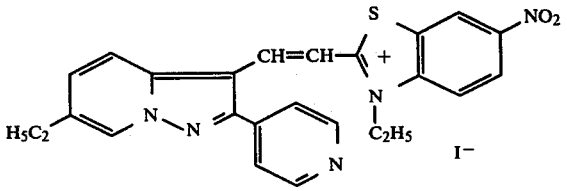
(507)
(96)
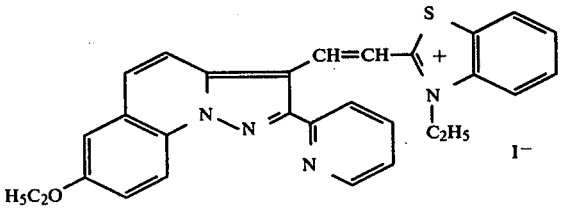
(470)
(97)
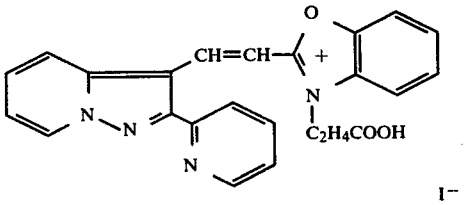
(440)

-continued
(98)
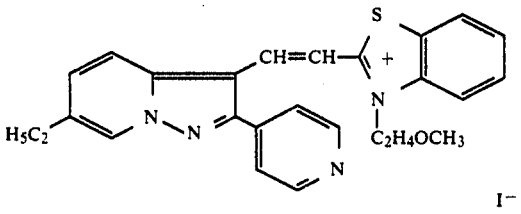
(470)
(99)
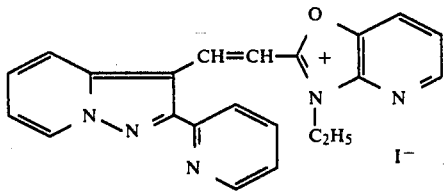
(450)
(100)
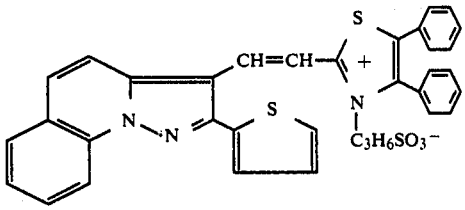
(467)
(101)
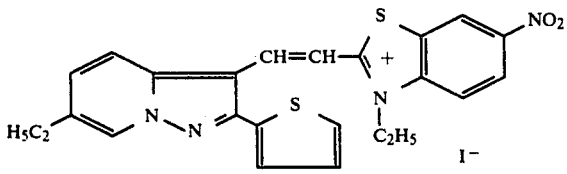
(518)
(102)
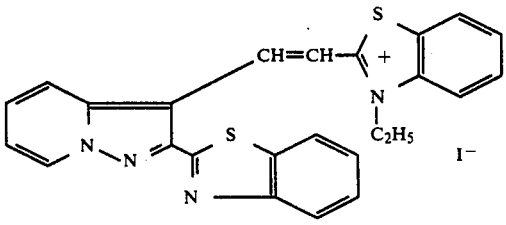
(465)
(103)
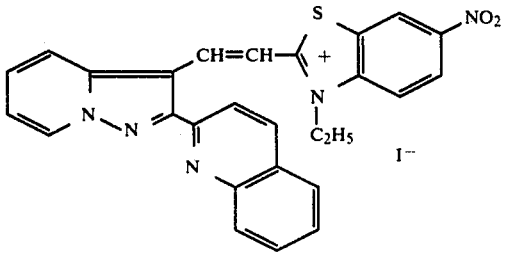
(513)

-continued
(104)
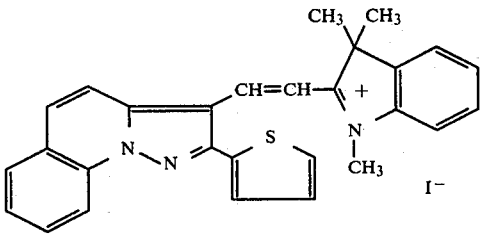
(481)
(105)
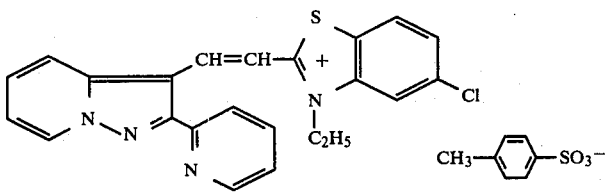
(480)
(106)
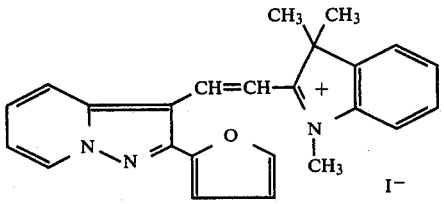
(483, 510)
(107)
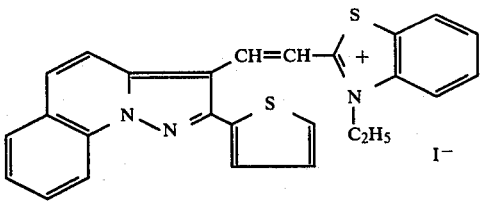
(465)
(108)
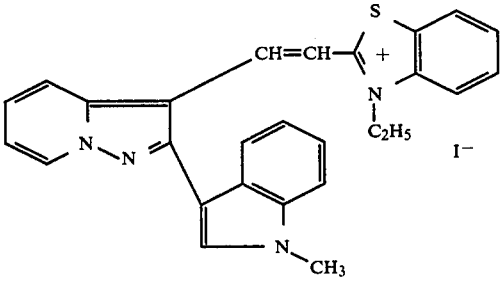
(493)
(109)
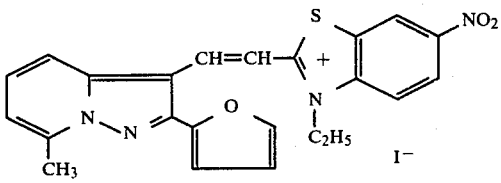
(522)

-continued
(110)
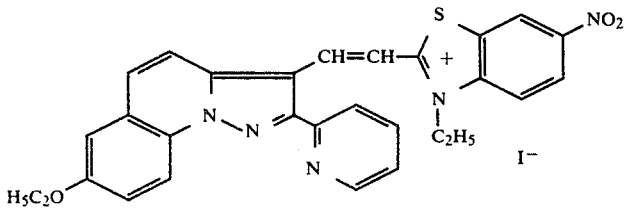
(514)
(111)
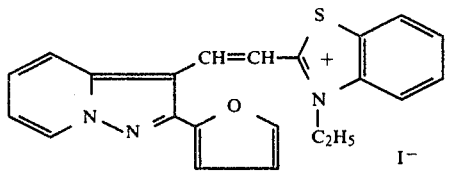
(470)
(112)
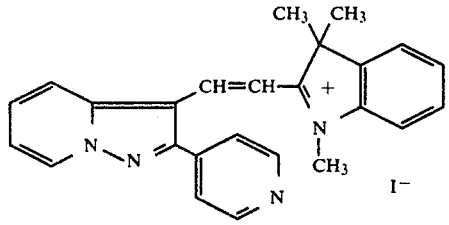
(476)
(113)
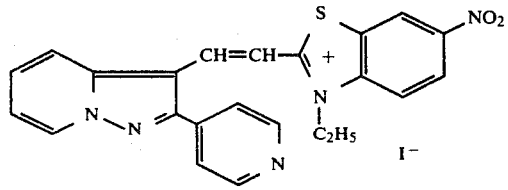
(497)
(114)
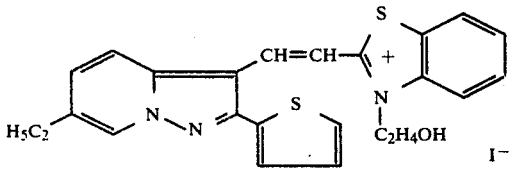
(484)
(115)
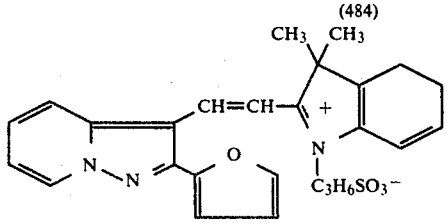
(487, 510)
(116)
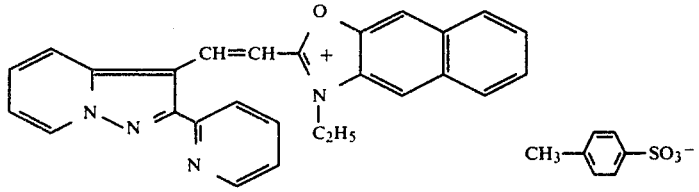
(455, 477)

-continued
(117)
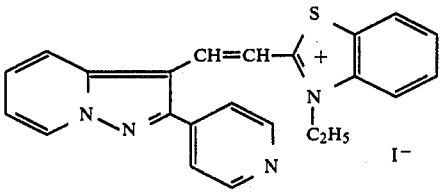
(459)
(118)
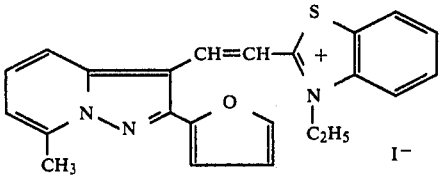
(485)
(119)
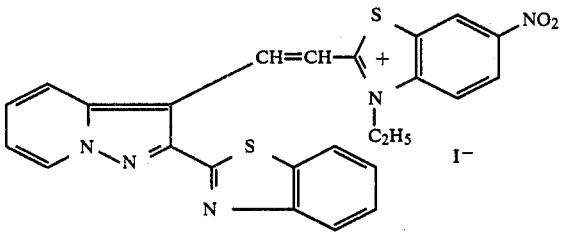
(480, 505)
(120)
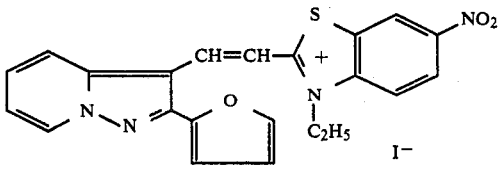
(513)
(121)
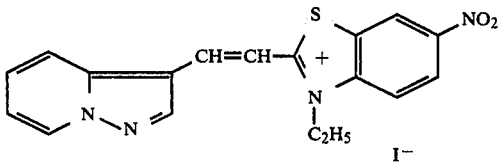
(500)
(122)
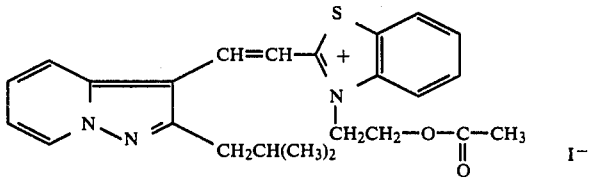
(485)
(123)
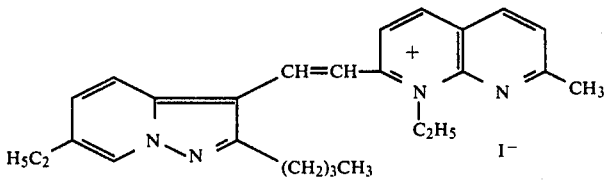
(505)

-continued
(124)
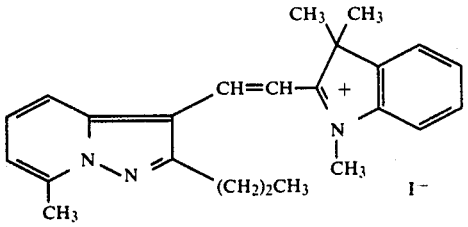
(485, 505)
(125)
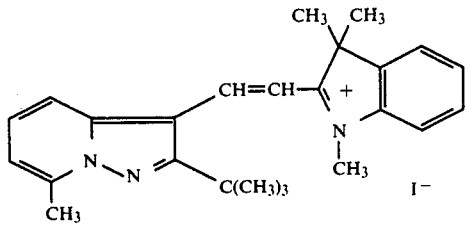
(511)
(126)
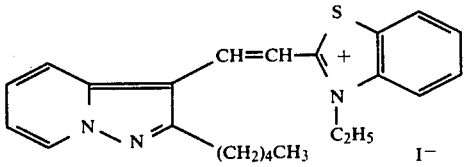
(475)
(127)
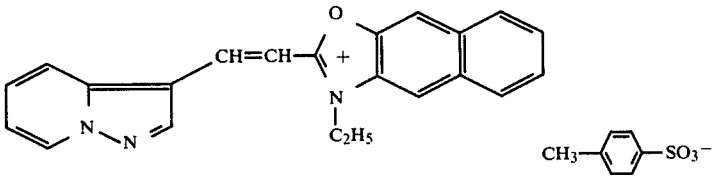
(450, 468)
(128)
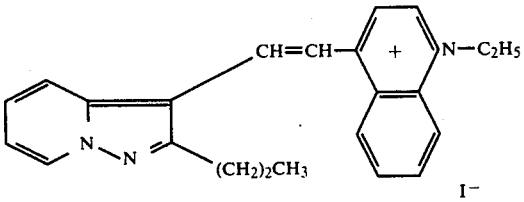
(495)
(129)
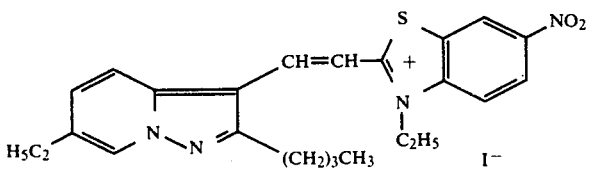
(515)
(130)
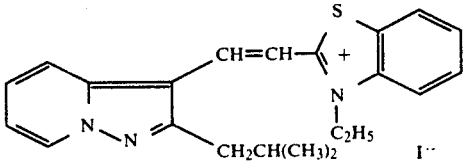
(476)

-continued
(131)
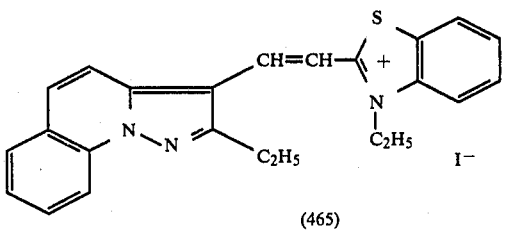
(465)
(132)
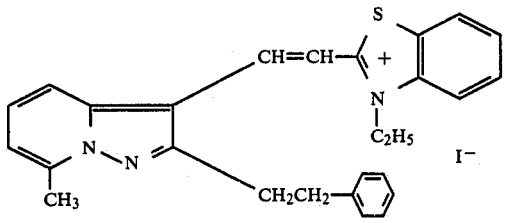
(490)
(133)
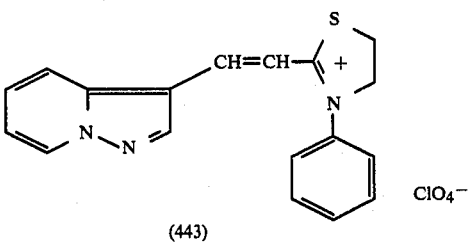
(443)
(134)
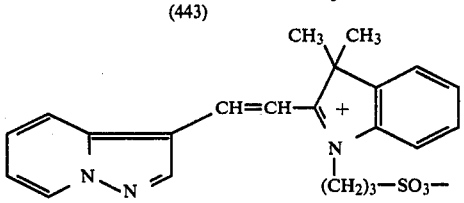
(482)
(135)
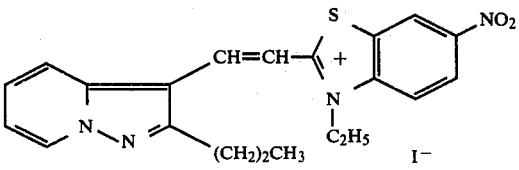
(508)
(136)
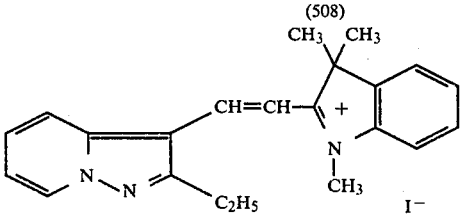
(479, 496)
(137)
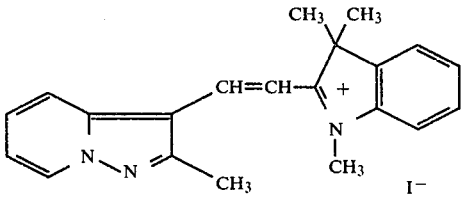
(478, 496)

-continued
(138)
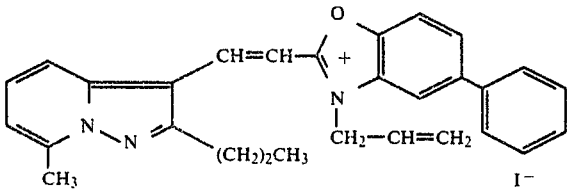
(509)
(139)
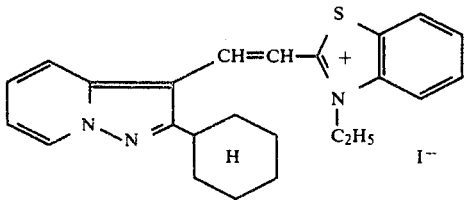
(480)
(140)
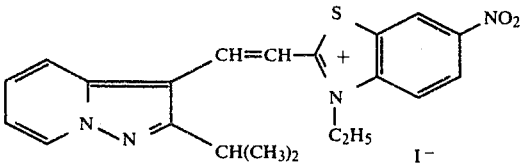
(509)
(141)
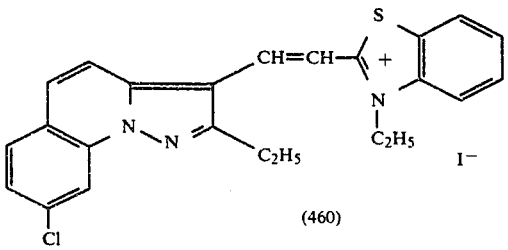
(460)
(142)
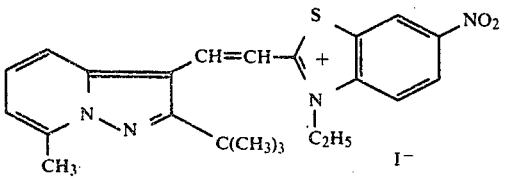
(521)
(143)
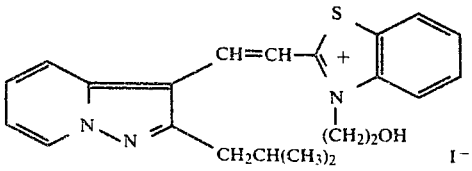
(483)
(144)
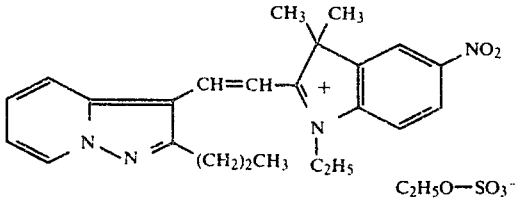
(519)

-continued
(145)
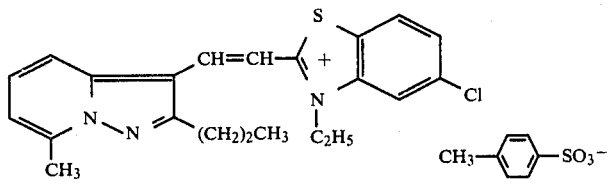
(499)
(146)
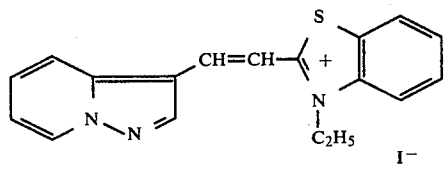
(462)
(147)
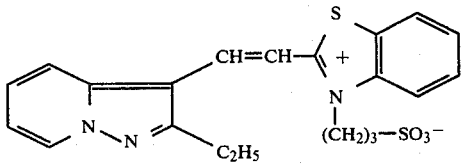
(485)
(148)
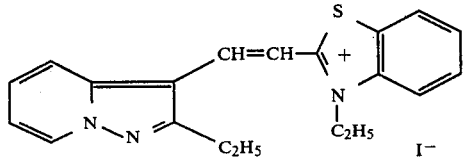
(476)
(149)
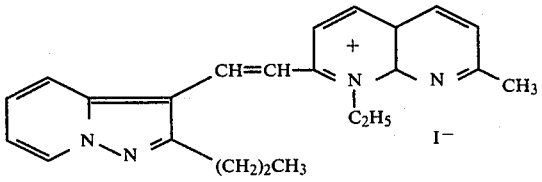
(496)
(150)
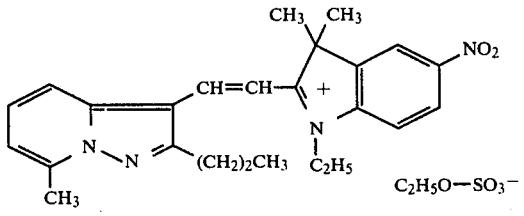
(525)
(151)
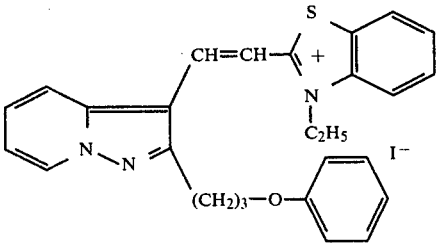
(470)

-continued
(152)
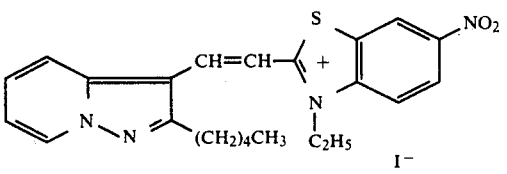
(508)
(153)
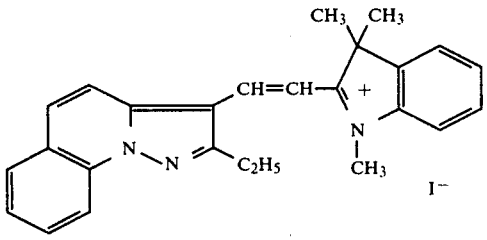
(479, 498)
(154)
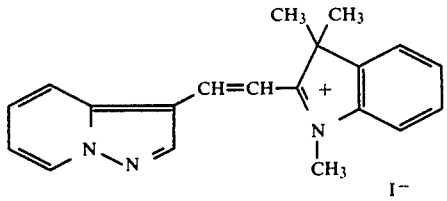
(473)
(155)
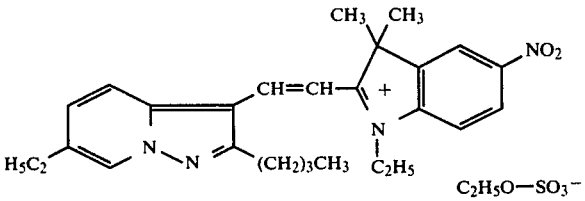
(495,523)
(156)
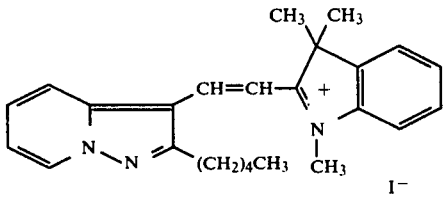
(480, 497)
(157)
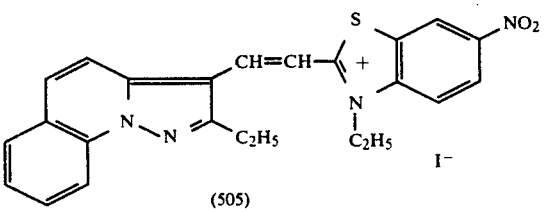
(505)
(158)
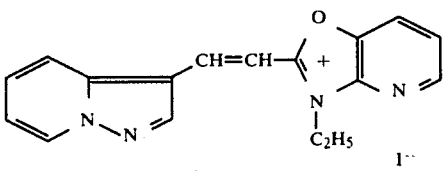
(450)

-continued
(159)
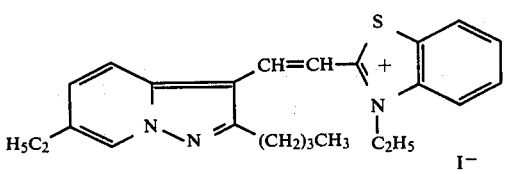
(487)
(160)
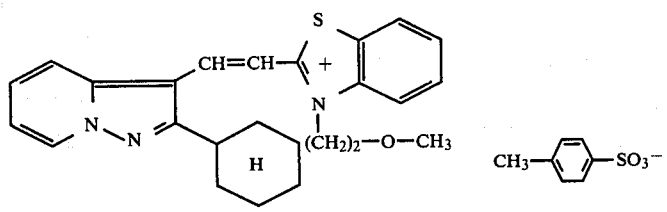
(482)
(161)
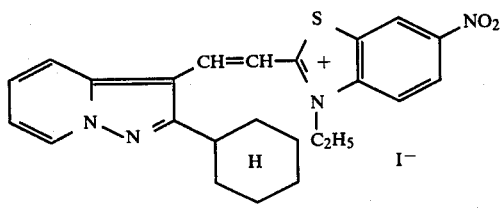
(510)
(162)
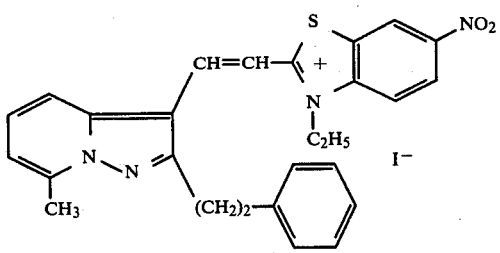
(515)
(163)
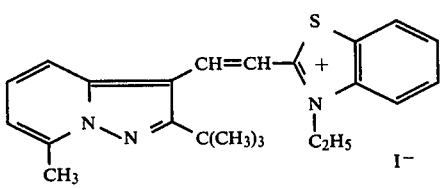
(496)
(164)
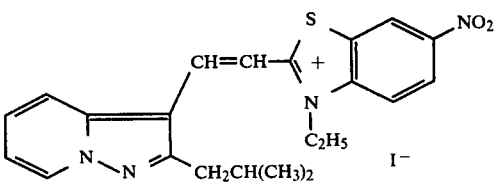
(508)
(165)
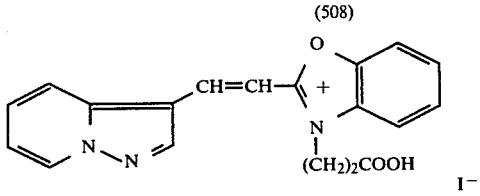
(435)

-continued
(166)
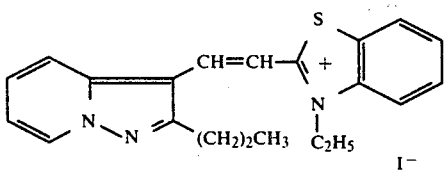
(475)
(167)
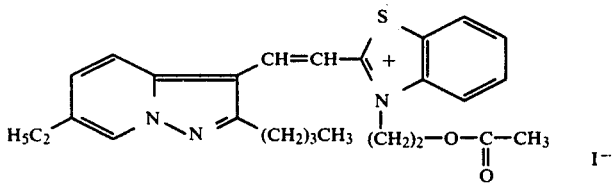
(494)
(168)
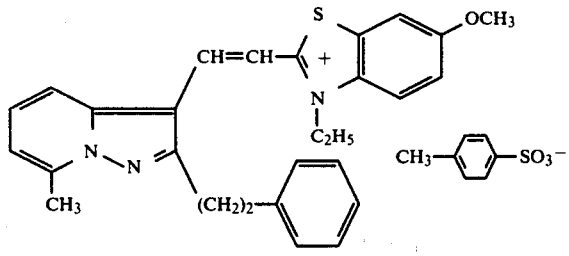
(475)
(169)
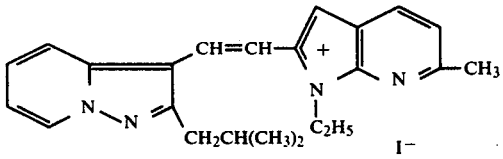
(495)
(170)
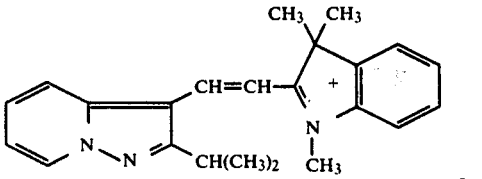
(490)
(171)
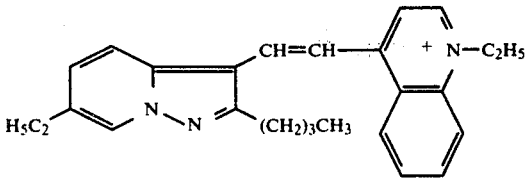
(505)
(172)
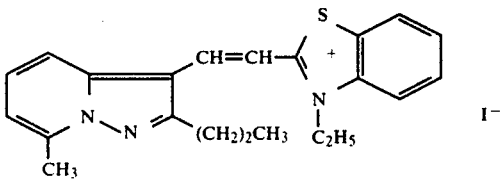
(490)

-continued
(173)
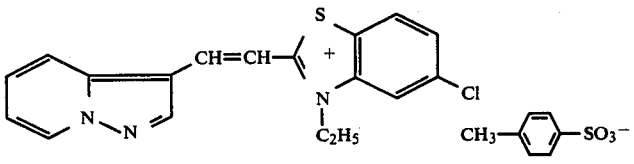
(476)
(174)
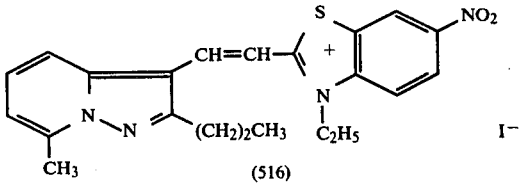
(516)
(175)
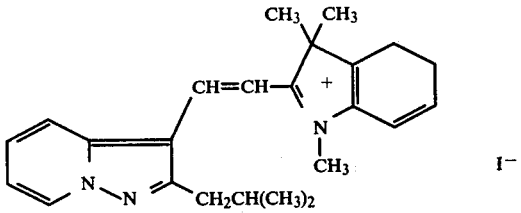
(479, 498)
(176)
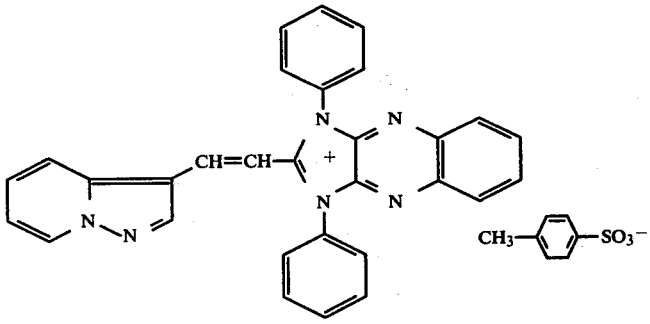
(500)
(177)
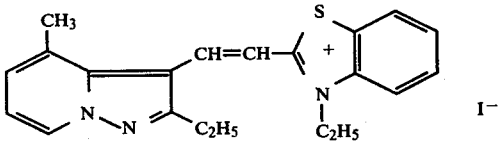
(485)
(178)
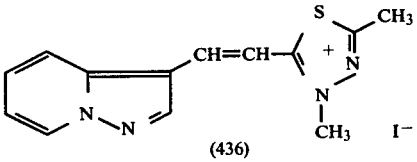
(436)
(179)
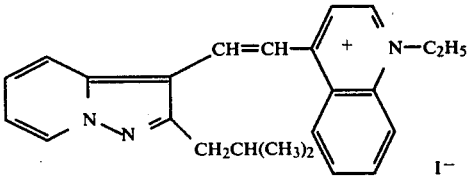
(494)

-continued
(180)
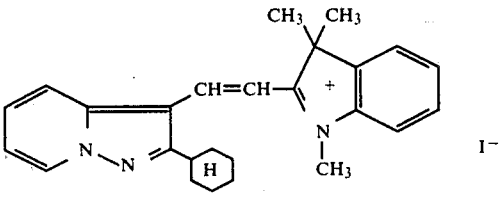
(490)
(181)
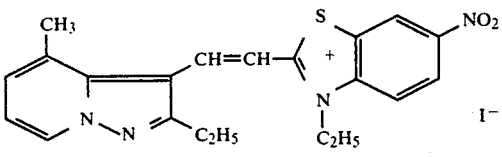
(513)
(182)
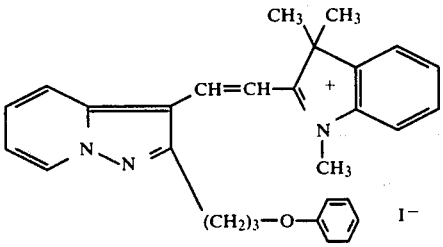
(479, 497)
(183)
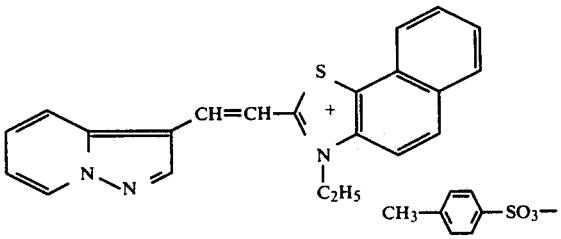
(472)
(184)
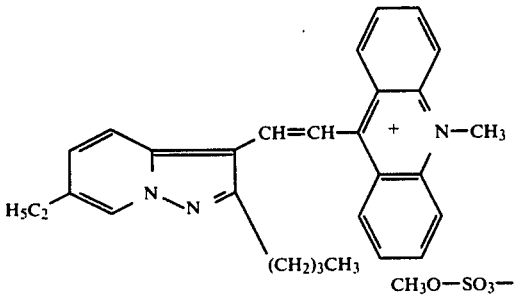
(588)
(185)
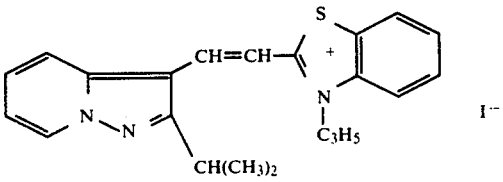
(480)

-continued
(186)
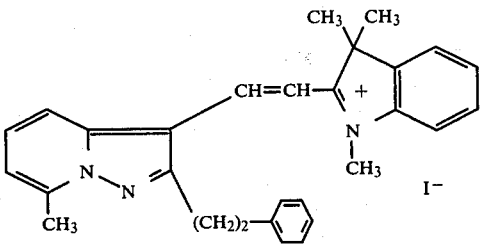
(505)
(187)
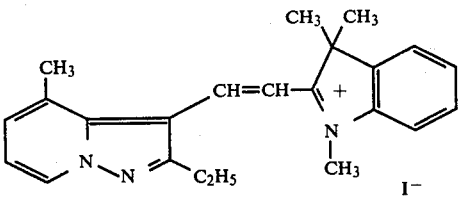
(482, 503)
(188)
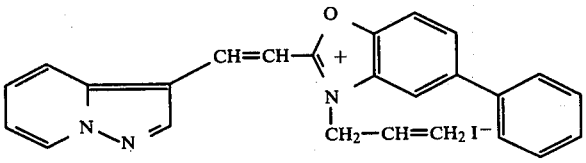
(445, 460)
(189)
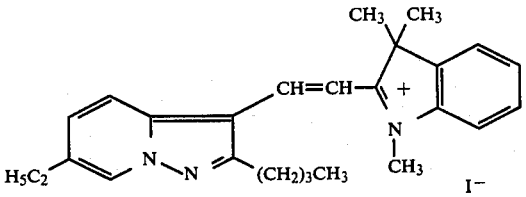
(485, 505)
(190)
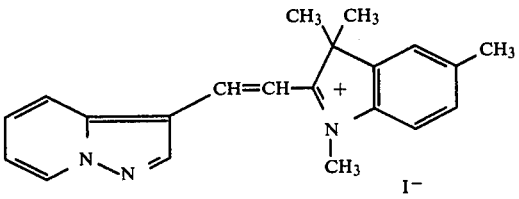
(477)
(191)
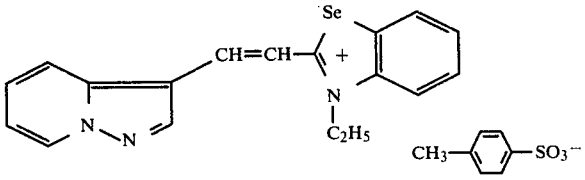
(471)

-continued
(192)
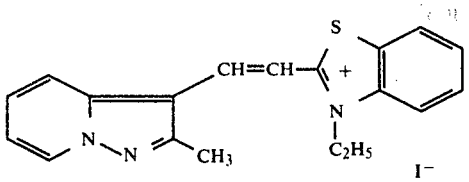
(473)
(193)
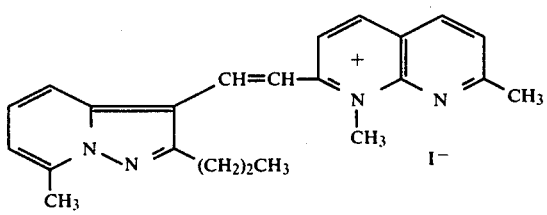
(507)
(194)
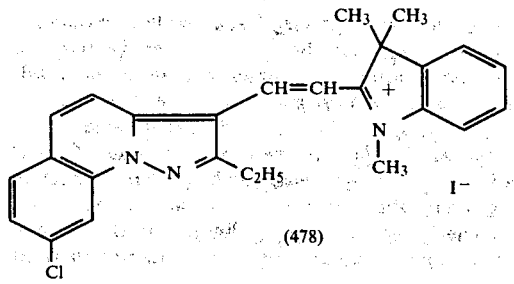
(478)
(195)
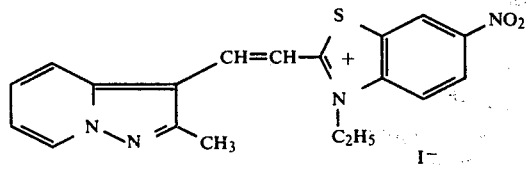
(506)
(196)
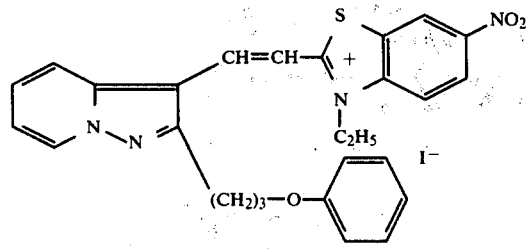
(506)
(197)
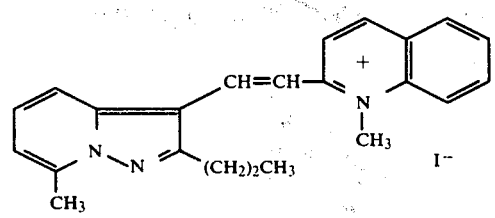
(488)
(198)
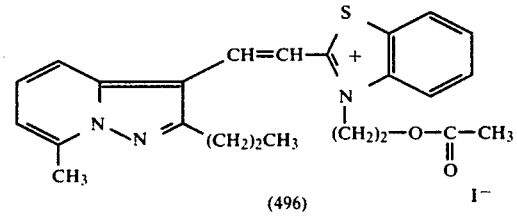
(496)

-continued (199)

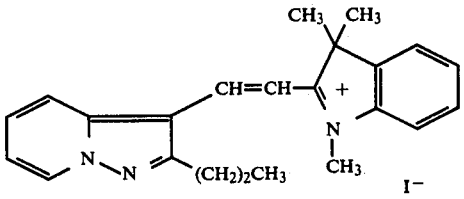

(479, 495)

(200)

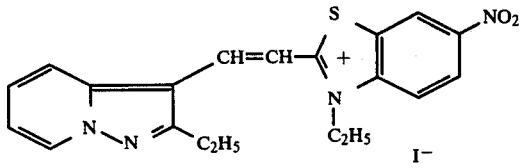

(507)

The dyes containing a pyrazolo[1,5-a]pyridine ring used in this invention may be synthesized in the following way. An acylmethylene compound, such as shown in Journal of the American Chemical Society, Vol. 73, pp. 696–697 and 4,301–4,303 (1951) and Vol. 74, pp. 5,217–5,217 (1952) is reacted in a way taught in Journal of Chemical Society, Vol. 1957, pp. 4,506–4,510 and Journal of Hetero Cyclic Chemistry, Vol. 12, pp. 481–483 (1975) to synthesize a pyrazolo[1,5-a]pyridine derivative, and then N,N-dimethylformamide and phosphorus oxychloride are reacted with this derivative to perform a so-called Vilsmeier-Haak reaction to obtain a formyl derivative, and the latter is then heated and reacted in a heterocyclic quaternary ammonium salt having an active methyl group and acetic anhydride, whereby the desired dimethine dye is obtained. The object dye can be also obtained by heating said formyl derivative in an innert solvent (such as ethanol or nitrobenzene) under the presence of base (such as potassium acetate, triethylamine or piperidine) instead of acetic anhydride. The above-said process is diagrammatized below.

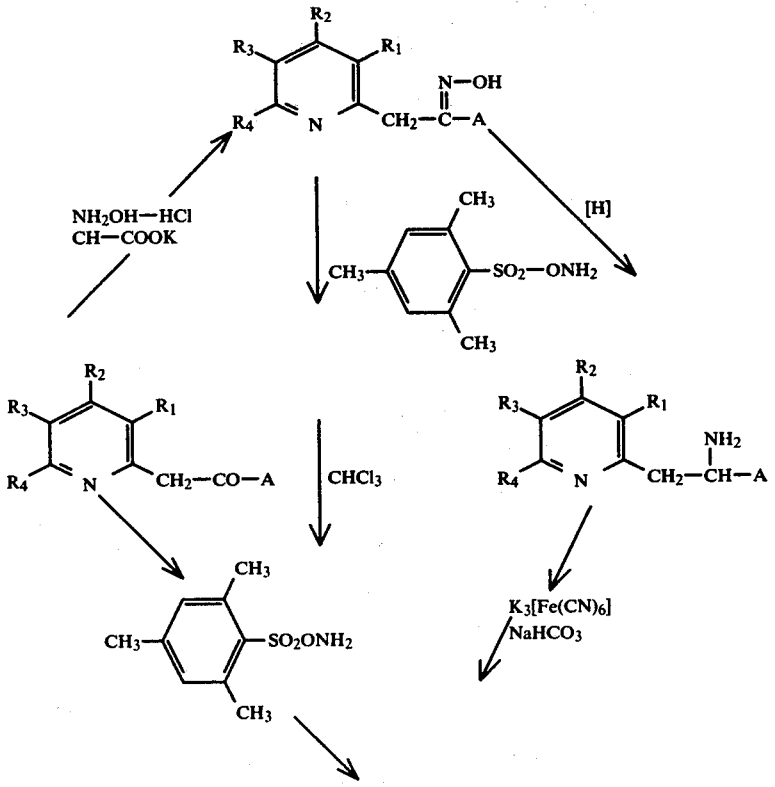

-continued

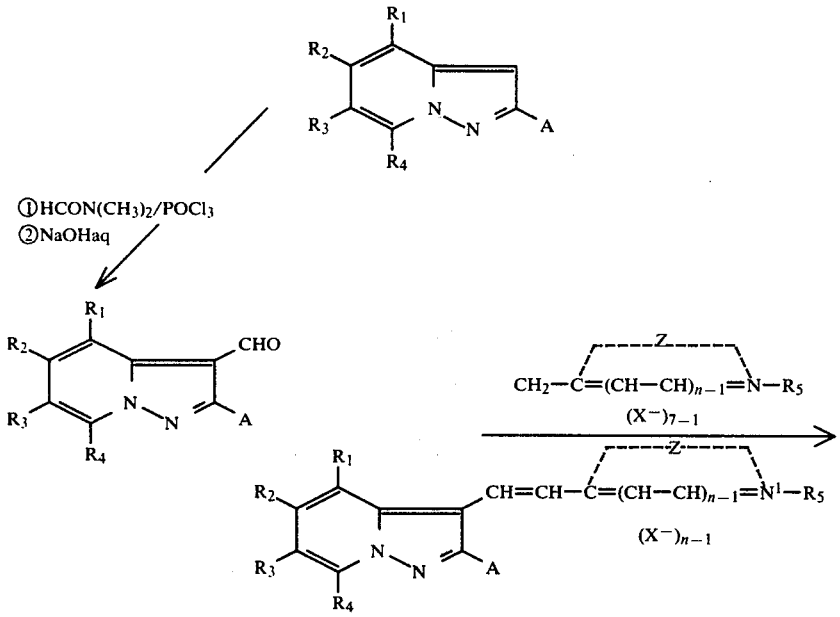

Described below are the typical examples of the syntheses of the dyes used in this invention.

Synthesis of Dye (19)

(I) Synthesis of the intermediate 14 ml of phosphorus oxychloride was added dropwise into 60 ml of dimethylformamide under ice-cooling and stirring, followed by dropwise addition thereto of a solution prepared by dissolving 15.7 gr of 2-(p-methoxyphenyl)pyrazolo[1,5-a]pyridine in 70 ml of dimethylformamide, and the mixture was further stirred at 35°–40° C. for one hour. The reaction solution was poured into ice-water and made alkaline with a sodium hydroxide solution. After several minutes of heating over a hot water bath, the reaction mixture was cooled with ice-water and the precipitated solid was collected by filtration and washed with water. When these products were recrystallized from ethanol and dried, there was obtained 16 gr, of colorless to white-colored needlelike crystals with melting point of 130.0°–131.0° C.

(II) 1.26 gr of 3-formyl-2-(p-methoxyphenyl)-pyrazolo[1,5-a]pyridine obtained in the above-said reaction and 1.79 gr of 1-ethyl-2,3,3-trimethyl-5-nitro-3H-indolium ethylsulfate in 10 ml. of acetic anhydride were refluxed for 15 minutes to react them. After cooling, the precipitate was collected by filtration and washed with a small quantity of ethanol, and then the product was recrystallized from ethanol and dried to obtain 0.88 gr of brilliant brown-colored fine plate crystals with melting point of 218.0° (dec.). Absorption maximum of the methanol solution: 523 nm.

Synthesis of Dye (20)

3.05 gr of 3-ethyl-2-methylbenzothiazolium iodide and 1.96 gr of potassium acetate were added into 2.20 gr of 3-formyl-2-phenylpyrazolo[1,5-a]pyridine (m.p.: 147.0°–148.0° C.), and the mixture in 100 ml. of ethanol was refluxed for 20 minutes. After cooling, the precipitated crude dye was collected by filtration and washed with water, followed by recrystallization from ethanol and drying to obtain 3.50 gr. of dark reddishorange flaky crystals with melting point of 226.5° C. (dec.). Absorption maximum of the methanol solution: 465 nm.

Synthesis of Dye (66):

(I) Synthesis of the intermediate 120 ml of phosphorus oxychloride was added dropwise into 48.0 ml of dimethylformamide under ice-cooling and stirring, followed by dropwise addition thereto of a solution prepared by dissolving 11.0 gr, of 2-(2-pyridyl)pyrazolo[1,5-a]pyridine (m.p.: 135.5°–136.5° C.) in 50 ml of dimethylformamide, and the mixture was further stirred at 35°–40° C. for one hour. The reaction solution was poured into ice-water and made alkaline with a sodium hydroxide solution. After heating over a hot water bath for several minutes, the reaction mixture was ice-cooled and the precipitated solids were collected by filtration and washed with water. Succeeding recrystallization from ethanol and drying gave 9.1 gr. of white needle-like crystals with melting point of 186.0°–187.0° C.

(II) Synthesis of the dye 1.1 gr, of 3-formyl-2-(2-pyridyl)pyrazolo[1,5-a]pyridine obtained in the above-described reaction and 1.5 gr of 1,2,3,3-tetramethyl-3H-indolium iodide in 10 ml. of acetic anhydride were refluxed for 5 minutes. After cooling, the precipitated crude dye was collected by filtration and washed with a small amount of ethanol, and this was followed by recrystallization from ethanol and drying to obtain 1.1 gr. of brilliant reddish brown plate crystals with melting point of 256.0° C. (dec.). Absorption maximum of the metahnol solution: 475 and 495 nm.

Synthesis of Dye (80)

1.3 gr of 6-ethyl-3-formyl-2-(2-thienyl)pyrazolo[1,5-a]pyridine, 1,5 gr. of 3-ethyl-2-methylbenzothiazolium iodide and 1.0 gr. of potassium acetate in 50 ml. of ethanol were refluxed for 20 minutes, and then after cooling, the precipitated crude dye was collected by filtration and washed with water. Upon recrystallization of the product with methanol and drying, there was obtained 1.9 gr. of reddish orange crystalline powder with melting point of 258.0° C. (dec.). Absorption maximum of the methanol solution: 485 nm.

Synthesis of Dye (136)

0.88 gr of 2-ethyl-3-formylpyrazolo[1,5-a]pyridine (m.p.: 61.0°-62.0° C.) and 1.50 gr of 1,2,3,3-tetramethyl-3H-indolium iodide in 10 ml. of acetic anhydride were refluxed for 5 minutes. After cooling, the precipitated crude dye was collected by filtration and washed with a small quantity of ethyl acetate, and the product was recrystallized from acetone and dried to obtain 0.35 gr. of reddish brown crystalline powder with melting point of 239.0° C. (dec.). Absorption maximum of the methanol solution: 479 and 496 nm.

Synthesis of Dye (146)

1.46 gr. of 3-formylpyrazolo[1,5-a]pyridine (m.p.: 88.5°-89.0° C.), 3.10 gr. of 3-ethyl-2-methylbenzothiazolium iodide and 1.96 gr of potassium acetate in 100 ml. of ethanol were refluxed for 20 minutes. After cooling, the precipitated crude dye was collected by filtration and washed with water, and this was followed by recrystallization from metanol and drying to obtain 2.0 gr. of reddish purple crystalline powder with melting point of 260.0° C. (dec.). Absorption maximum of the methaol solution: 462 nm.

Other dyes usable in this invention can be easily synthesized in the similar way.

The silver halide emulsions usable in this invention include, for example, silver chloride emulsion, silver bromide emulsion, silver chloroiodide emulsion, silver iodobromide emulsion and silver chloroiodobromide emulsion, but the silver iodobromide emulsion is most preferred for obtaining a high-sensitivity direct positive emulsion. The grain size of such silver halide preparations may be within the range usually employed, but good results can be obtained when such preparations have the mean grain size of less than about 0.5μ.

The silver halide emulsion used in this invention may be either a monodispersed emulsion or a non-monodispersed emulsion although the former is usually preferred. The term "monodispersed emulsion" used herein means an emulsion prepared such that at least 95% by weight of the photographic silver halide grains have the grain sizes of less than about 40%, preferably less than about 30% of the mean grain size, as for instance shown in U.S. Pat. No. 3,501,305.

The silver halide crystal grains used in this invention may be of any crystal habit, but cubic grains are preferred. Also, the crystal grains used in this invention may be either regular or irregular although the regular grains are preferred. The "regular grains", as for instance shown in U.S. Pat. No. 3,501,306, are the grains having no twinning plane while the "irregular grains" are the grains having such twinning plane. It is desirable that, in the emulsion used in this invention, more than 80% (by weight) of the silver halide grains are the regular grains.

It is also possible to use in this invention an emulsion of the type in which the silver halide crystal has the nuclei capable of trapping the free electrons and the surface of such crystal has been fogged with a chemical fogging agent. This type of emulsion is characterized by its tendency to cause solarization and its ability to form a direct positive image. Use of spectral sensitization by a sensitizing dye leads to an even better effect. The preparation process of this type of emulsion is shown, for instance, in U.S. Pat. Nos. 3,367,778, 3,632,340 and 3,709,689.

The silver halide emulsion used in this invention is fogged either optically or chemically. The chemically fogged nuclei can be provided by a variety of methods generally used for chemical sensitization, with particular good results being obtained by using the method disclosed by Antoine Hautot and Henri Saubenier in Science et Industries Photographigue, Vol. 28 pp. 57-65 (1957). Such fogging may be also effected by using a reducing agent such as stannous chloride, thiourea dioxide, formalin, alkali arsenite, hydrazine and its derivatives, amineborane, etc.

In the present invention, it is desirable to give fogging by using a metallic compound which is electrically more positive than silver, with the examples of such compound being shown below. It is also advisable to give fogging by combined use of a reducing agent and a metallic compound electrically more positive than silver. Examples of the metallic compounds electrically more positive than silver are gold salts such as potassium chloroaurate, platinum salts such as potassium chloroplatinate, and iridium salts such as potassium hexachloroiridate. Good fogging can be also obtained for combined use of the above-said material and a sulfur-containing sensitizer such as sodium thiosulfate or a thiocyanic acid compound such as potassium thiocyanate.

It is also desirable to incorporate an electron trapping agent in the direct positive silver halide emulsion of this invention. The organic desensitizer known as the electron trapping agent is usually defined as a substance having the lowest vacant electron energy level which is lower than the electron energy level of the silver halide grains. Preferably, the highest occupied electron energy level of the desensitizer is lower than the electron energy level of the conduction band of the silver halide grains. It is well known that these electron energy levels have close relation to both anode polarographic half-wave potential and cathode polarographic half-wave potential. Such relation is for instance discussed in R. W. Berriman and P. B. Gilman, Jr.: Photographic Science and Engineering, Vol. 17, pp. 235-244 (1973), and L. Costa, F. Grum and P. B. Gilman, Jr.: Photographic Science and Engineering, Vol. 18, pp. 261-275 (1974). The organic desensitizers recommended for use in this invention are those whose anode polarographic half-wave potential is on the positive side of +1.0 volts and cathode polarographic half-wave potential is on the positive side of −1.0 volts. Such organic desensitizers are shown, for example, in U.S. Pat. Nos. 2,930,694, 3,367,779, 3,431,111, 3,492,123, 3,501,309, 3,501,310, 3,528,811, 3,574,629, 3,579,344, 3,579,345, 3,582,348, 3,592,653 and 3,598,595, British Pat. No. 1,192,384, and Japanese Patent Publication No. 14,500/68.

The cyanine dyes and merocyanine dyes containing at least one, preferably two desensitizing substituents such as nitro groups are also among the effective organic desensitizers.

Typical examples of the desensitizers usable in this invention are listed below: pinakryptol yellow, phenosafranine, Methylene Blue, Capri Blue, Amethyst Violet, pinakryptol green, Crystal Violet, 5-metanitrobenzylidenerhodanine, 3-ethyl-5-metanitrobenzylidenerhodanine, 3-ethyl-5-(2,4-dinitrobenzylidene)rhodanine, 5-orthonitrobenzylidene, 1,3-diethyl-6-nitro-2'-cyanine iodide, 3,3'-diethyl-6,6'-dinitro-9-phenylthiacarbocyanine iodide, 6-chloro-4-nitrobenzotriazole, 3-ethyl-2-

(paradimethylaminophenyliminomethyl)benzothiazolium ethylsulfate, 1,3-diamino-5-methylphenadium chloride, 3,3'-diparanitrobenzylthiacarbocyanine bromide, 3,3'-diorthonitrophenylthiacarbocyanine iodide, bis(4,6-diphenylpyril-2)carbocyanine perchlorate, and anhydro-2-paradimethylaminophenyliminomethyl-6-nitro-3-(4-sulfobutyl)benzothiazolium hydroxide. Among these desensitizers, pinakryptol yellow is most preferred.

In the emulsions used in this invention, gelatin is principally used as protective colloid. It is also possible to use a photographically inert gelatin derivative or a water-soluble synthetic polymer (such as acrylamide-acrylic acid copolymer, polyvinylalcohol, polyvinylpyrrolidone, polyvinyl alginate, etc.).

The direct positive silver halide emulsion of this invention may contain various kinds of additives such as fogged nucleus stabilizer, brightening agent, ultraviolet absorber, cleaning property improver, hardener, surfactant, antiseptic, plasticizer, matting agent, color coupler, etc.

In this invention, two or more of the said dyes are used in combination to provide higher spectral sensitivity that meets the purpose of use.

The amount of the dye used in this invention should be less than $1\times10^{-2}$ moles, preferably $3\times10^{-5}$ to $5\times10^{-3}$ moles, per mole of silver halide. Such dye is dissolved in water or a suitable solvent such as methanol, ethanol, dimethylformamide, acetone, pyridine or the like and then added into the emulsion. A dispersion method by means of ultraviolet vibration may be employed for effecting such dissolution of the dye. Addition of the dye into the emulsion may be made at any stage of the emulsion preparation process, but it is advantageous to add the dye immediately before coating. The amount and method of addition of the organic desensitizer or known cyanine dye may be similarly determined.

The direct positive silver halide emulsion according to this invention can be applied to various kinds of supports such as for example cellulose acetate film, cellulose nitrate film, polyvinyl acetate film, polystyrene film, polyethylene terephthalate film and other polyester films as well as glass, metal, wood, etc. Plastic-laminated paper may be also used as support.

The emulsion of this invention is subjected, after exposure, to the treatments with the known treating baths for development, fixation, bleaching, etc., or with a combined treating bath.

As viewed above, the first feature of this invention resides in spectral sensitization of the direct positive silver halide emulsion by use of a novel dimethine dye containing a pyrazolo[1,5-a]pyridine ring.

The second feature of this invention resides in the fact that a high-contrast direct positive silver halide emulsion can be obtained by using a novel dimethine dye containing a pyrazolo[1,5-a]pyridine ring.

The third feature of this invention is that no coloring (color strain) is caused by residual dye even if a novel dimethine dye containing a pyrazolo[1,5-a]pyridine ring is used.

Combined use of the novel dye according to this invention and a known cyanine dye can provide a high-contrast direct positive silver halide emulsion with even higher sensitivity.

The direct positive silver halide emulsion according to this invention can be used for various applications, for example, for copying sensitive material for lithographic type films, direct positive color sensitive material, copying sensitive material for microfilms, and copying sensitive material for X-ray films.

The photographic emulsion according to this invention is useful not only for exposure by light but also for exposure by means of electron beams, X-rays and gamma-rays.

The novel dyes containing a pyrazolo[1,5-a]pyridine ring used in this invention can be also used as filter dye, anti-irradiation dye and antihalation dye.

The invention is now described in further detail with relation to the following examples.

EXAMPLE 1

The following solutions I-IV were prepared.

| | |
|---|---|
| Solution I | |
| Gelatin | 5 g |
| 0.1N aqueous solution of potassium bromide | 20 ml |
| Water | to make a 200 g mixture |
| 1N sulfuric acid | to adjust pH to 5.0 |
| Solution II | |
| Silver nitrate | 136 g |
| Water | to make a 400 ml mixture |
| Solution III | |
| Potassium bromide | 92.8 g |
| Potassium iodide | 3.3 g |
| Gelatin | 16 g |
| Water | to make a 400 ml mixture |
| Solution IV | |
| 6N sulfuric acid | |

Solution I was vigorously agitated while maintaining its temperature at 60° C., and to this solution I were simultaneously added the solutions II and III over the period of 80 minutes, and during this time PAg was controlled to 7.4. Then the solution IV was added, and after adjusting pH to 4.0, the mixed solution was subjected to flocculation to form a precipitate and the latter was washed with water. The thus obtained primitive emulsion was a silver iodobromide emulsion containing 97.5 mol% of bromide. It was also a cubic monodisperse emulsion having the average grain size of 0.25μ, with more than 95 wt% of the grains being within ±20% of the average particle size. This primitive emulsion was re-dissolved and added with gelatin while adjusting its pH to 6.5 and PAg to 6.0. Then thiourea dioxide was added in an amount of 0.2 mg per mole of Ag and the mixture was aged at 65° C. for 60 minutes, and this was followed by further addition of 2 mg/mole Ag of chloroauric acid and additional 60-minute aging at 65° C. Thereafter, PAg and pH were adjusted to 8.0 and 5.0, respectively, and the product was divided into twenty equal portions and each portion, except for the control, was added with a sensitizing dye according to the prescription of Table 1. Each of these emulsion specimens was added with pinakryptol yellow in an amount of 200 mg per mole of Ag as well as a hardener and a surfactant, then applied to a polyethylene terephthalate film provided with an undercoating layer and then dried. The silver deposit as calculated in terms of Ag was 3.4 g/m$^2$.

Each of the thus prepared specimens was cut into a suitable size, then exposed through a wedge with density difference of 0.15 and then developed with a three times diluted version of Eastman Kodak's D-72 developing solution at 20° C. for 90 seconds, followed by fixation, washing with water and drying. The results of the density measurements gave the characteristic value shown in Table 1 below.

TABLE 1

| Specimen | Dye | Loading (mg/mol Ag) | S | γ | Dmax | Dmin | Spectral sensitization range (nm) |
|---|---|---|---|---|---|---|---|
| 1 | Control | — | 1.0 | 4.6 | >4 | .04 | — |
| 2 | (1) | 350 | 9.5 | 4.5 | >4 | .03 | 450–560 |
| 3 | (3) | 350 | 4.2 | 4.8 | >4 | .04 | 450–566 |
| 4 | (5) | 350 | 6.0 | 4.6 | >4 | .03 | 460–570 |
| 5 | (6) | 350 | 6.2 | 4.8 | >4 | .03 | 450–525 |
| 6 | (8) | 350 | 4.2 | 4.2 | >4 | .04 | 450–525 |
| 7 | (11) | 350 | 3.4 | 4.2 | >4 | .04 | 460–540 |
| 8 | (13) | 350 | 8.1 | 4.6 | >4 | .03 | 470–600 |
| 9 | (14) | 350 | 2.2 | 4.4 | >4 | .03 | 450–500 |
| 10 | (18) | 350 | 3.8 | 5.1 | >4 | .03 | 460–570 |
| 11 | (19) | 350 | 10.1 | 5.0 | >4 | .03 | 480–615 |
| 12 | (27) | 350 | 3.4 | 4.6 | >4 | .03 | 450–530 |
| 13 | (30) | 350 | 8.1 | 4.8 | >4 | .03 | 470–605 |
| 14 | (33) | 350 | 6.0 | 5.0 | >4 | .03 | 460–580 |
| 15 | (35) | 350 | 6.2 | 4.8 | >4 | .03 | 470–580 |
| 16 | (42) | 350 | 2.2 | 4.6 | >4 | .03 | 450–550 |
| 17 | (48) | 350 | 8.1 | 4.8 | >4 | .03 | 450–570 |
| 18 | (50) | 350 | 2.4 | 4.8 | >4 | .03 | 450–550 |
| 19 | (52) | 350 | 8.1 | 4.9 | >4 | .03 | 460–575 |
| 20 | (54) | 350 | 3.4 | 4.2 | >4 | .04 | 450–550 |

In the above table, Dmax and Dmin indicate the maximum optical density and minimum optical density, respectively, S is sensitivity expressed in terms of the reciprocal of the amount of exposure necessary for providing the density of 1.0, the γ is gradient between densities 0.5 and 2.5. The minimum optical density is the value including the base density.

As apparent from Table 1, the dimethine dyes containing a pyrazolo[1,5-a]pyridine ring according to this invention show about double to about 10 times as high sensitization effect as the control and are capable of providing a high-contrast direct positive silver halide emulsion substantially free from discoloring by residual dye. It will thus be understood that the dimethine dyes containing a pyrazolo[1,5-a]pyridine ring provided according to this invention are very useful for obtaining a high-sensitivity, high-contrast and non-discolored direct positive silver halide photographic emulsion which is the object of this invention.

EXAMPLE 2

A primitive emulsion was prepared in the same way as used in Example 1, and this primitive emulsion was re-dissolved, added with gelatin and adjusted in pH to 6.5 and in PAg to 4.9. After adding potassium chloroaurate in an amount of 3 mg per mole of Ag, the mixed solution was aged at 65° C. for 90 minutes, and thereafter PAg and pH were adjusted to 8.0 and 5.0, respectively. Each specimen was then added with a sensitizing dye according to the prescription of Table 2, then further added with 200 mg/mol Ag of pinakryptol yellow as well as a hardener and a surfactant, and then applied to a polyethylene terephthalate film provided with undercoating, following by drying. The silver coating build-up, calculated in terms of Ag, was 3.4 g/m$^2$.

The treatment conducted after the manner of Example 1 gave the results shown in Table 2 below.

TABLE 2

| Specimen | Dye | Loading (mg/mol Ag) | S | γ | Dmax | Dmin | Spectral sensitization range (nm) |
|---|---|---|---|---|---|---|---|
| 21 | Control | — | 1.0 | 4.6 | >4 | .04 | — |
| 22 | (2) | 350 | 6.0 | 4.6 | >4 | .03 | 460–585 |
| 23 | (7) | 350 | 3.4 | 4.6 | >4 | .04 | 450–530 |
| 24 | (8) | 350 | 4.0 | 4.8 | >4 | .03 | 460–570 |
| 25 | (10) | 350 | 8.1 | 4.5 | >4 | .03 | 470–600 |
| 26 | (12) | 350 | 9.5 | 4.6 | >4 | .03 | 470–650 |
| 27 | (15) | 350 | 8.2 | 4.5 | >4 | .03 | 460–575 |
| 28 | (17) | 350 | 6.0 | 4.6 | >4 | .03 | 460–590 |
| 29 | (20) | 350 | 10.1 | 5.0 | >4 | .03 | 450–575 |
| 30 | (21) | 350 | 8.2 | 4.5 | >4 | .03 | 490–625 |
| 31 | (22) | 350 | 4.2 | 4.5 | >4 | .03 | 460–580 |
| 32 | (25) | 350 | 6.9 | 4.5 | >4 | .03 | 460–585 |
| 33 | (26) | 350 | 6.0 | 4.6 | >4 | .03 | 460–580 |
| 34 | (31) | 350 | 6.0 | 4.5 | >4 | .03 | 460–580 |
| 35 | (34) | 350 | 9.5 | 4.6 | >4 | .03 | 480–620 |
| 36 | (37) | 350 | 8.1 | 4.6 | >4 | .03 | 460–575 |
| 37 | (38) | 350 | 6.0 | 4.8 | >4 | .03 | 470–590 |
| 38 | (39) | 350 | 6.0 | 4.6 | >4 | .03 | 470–585 |
| 39 | (43) | 350 | 11.6 | 4.4 | >4 | .03 | 480–640 |
| 40 | (45) | 350 | 6.5 | 4.5 | >4 | .03 | 460–585 |
| 41 | (46) | 350 | 8.2 | 4.5 | >4 | .03 | 450–550 |
| 42 | (49) | 350 | 6.0 | 4.6 | >4 | .03 | 460–570 |
| 43 | (51) | 350 | 10.1 | 4.6 | >4 | .03 | 470–605 |

As apparent from Table 2, the dimethine dye preparations containing a pyrazolo[1,5-a]pyridine ring according to this invention show about thrice to about 12 times as high sensitization effect as the control and are capable of providing a high-contrast direct positive silver halide emulsion minimized in coloring by residual dye.

EXAMPLE 3

Specimens were prepared in the same way as Example 3 except for use of the dyes specified in Table 3, and these specimens produced the results shown in Table 3 below.

TABLE 3

| Specimen | Dye | Loading (mg/mol Ag) | S | γ | Dmax | Dmin | Spectral sensitization range (nm) |
|---|---|---|---|---|---|---|---|
| 44 | Control | — | 1.0 | 4.6 | >4 | .04 | — |
| 45 | (4) | 350 | 2.2 | 4.6 | >4 | .03 | 480–590 |
| 46 | (16) | 350 | 6.0 | 4.6 | >4 | .032 | 460–575 |
| 47 | (23) | 350 | 4.2 | 4.6 | >4 | .03 | 450–540 |
| 48 | (24) | 350 | 9.5 | 4.7 | >4 | .04 | 480–620 |
| 49 | (29) | 350 | 8.1 | 4.7 | >4 | .03 | 480–620 |
| 50 | (32) | 350 | 3.1 | 4.4 | >4 | .03 | 480–590 |
| 51 | (41) | 350 | 8.1 | 4.7 | >4 | .03 | 460–580 |
| 52 | (44) | 350 | 4.5 | 4.5 | >4 | .03 | 480–590 |
| 53 | (53) | 350 | 4.2 | 4.5 | >4 | .03 | 480–595 |

As evident from Table 3, the dimethine dye preparations containing a pyrazolo[1,5-a]pyridine ring according to this invention demonstrate about double to about 10 times as high sensitization effect as the control and are capable of providing a high-contrast direct positive silver halide emulsion almost free from discoloring by residual dye.

EXAMPLE 4

A silver iodobromide emulsion (with 2 mol% of iodine) was prepared according to the "control double run" method. This crude emulsion was cubic in crystal form, and it was a monodispersed emulsion having average grain size of 0.25μ, with more than 95 wt% of the grains having the sizes within 30% of the average size. After precipitation and washing with water, gelatin was added while adjusting pH to 8.0 and PAg to 5.0, followed by further addition of potassium chloroaurate in an amount of 2 mg per mole of Ag, and after 2-hour fogging at 60° C., PAg and pH were adjusted to 8.5 and 5.0, respectively, and then the emulsion was divided into several ten equal portions and each portion was added with a dimethine dye according to the prescription of Table 1. Each specimen was further added with pinakryptol yellow in an amount of 200 mg per mole of Ag as well as a hardening agent and a surface active agent and then applied to a polyethylene terephthalate film provided with undercoating. The coating build-up as reduced to the silver nitrate basis was 3.7 g/m$^2$.

After drying, each specimen was cut into a suitable size, exposed through an optical wedge with density difference of 0.15 and then developed with a three-time diluted version of Eastman Kodak's D-72 developing solution at 20° C. for 90 second, followed by fixation with an acidic fixing solution, washing with water and drying. The data of Table 4 were obtained as a result of density measurements.

In the table, relative sensitivity S is the relative value of log (amount of exposure) determined at density 1.0, $\overline{\gamma}$ is gradient at the linear section between densities 0.5 and 2.0, and the maximum density $D_{max}$ and minimum density $D_{min}$ include the base density.

TABLE 4

Photographic properties of respective specimens

| Specimen No. | Dye No. | Loading (mg/mol Ag) | S | $\overline{\gamma}$ | $D_{min}$ | Spectral sensitization range (nm) |
|---|---|---|---|---|---|---|
| 54 | Control | — | 1.0 | 5.0 | .05 | — |
| 55 | (57) | 350 | 9.4 | 5.3 | .04 | 460-605 |
| 56 | (58) | 350 | 9.4 | 6.0 | .04 | 460-590 |
| 57 | (59) | 350 | 5.6 | 5.4 | .04 | 460-580 |
| 58 | (61) | 350 | 4.7 | 4.9 | .04 | 480-615 |
| 59 | (62) | 350 | 6.7 | 5.1 | .04 | 470-620 |
| 60 | (64) | 350 | 11.2 | 5.4 | .04 | 450-640 |
| 61 | (66) | 350 | 5.6 | 4.8 | .04 | 460-570 |
| 62 | (67) | 350 | 7.9 | 5.3 | .04 | 460-620 |
| 63 | (68) | 350 | 5.9 | 5.0 | .04 | 470-570 |
| 64 | (69) | 350 | 6.7 | 5.0 | .04 | 460-570 |
| 65 | (71) | 350 | 7.9 | 5.6 | .04 | 450-570 |
| 66 | (72) | 350 | 5.6 | 5.1 | .05 | 470-580 |
| 67 | (73) | 350 | 7.9 | 5.6 | .04 | 460-605 |
| 68 | (74) | 350 | 4.0 | 5.9 | .04 | 460-590 |
| 69 | (76) | 350 | 6.7 | 5.7 | .04 | 460-575 |
| 70 | (77) | 350 | 6.7 | 5.3 | .04 | 460-595 |
| 71 | (78) | 350 | 9.4 | 5.5 | .04 | 470-580 |
| 72 | (69) | 300 | 4.7 | 4.9 | .04 | 450-590 |
| 73 | (80) | 350 | 9.4 | 5.1 | .04 | 460-580 |
| 74 | (81) | 350 | 6.7 | 5.0 | .04 | 470-605 |
| 75 | (82) | 350 | 7.9 | 5.0 | .04 | 460-600 |
| 76 | (83) | 350 | 7.9 | 5.1 | .04 | 460-570 |
| 77 | (84) | 350 | 9.4 | 5.3 | .05 | 475-600 |
| 78 | (85) | 350 | 4.0 | 5.0 | .04 | 450-550 |
| 79 | (86) | 350 | 4.7 | 5.0 | .04 | 440-550 |
| 80 | (87) | 350 | 9.4 | 5.4 | .04 | 460-605 |
| 81 | (88) | 350 | 4.7 | 4.8 | .04 | 450-555 |
| 82 | (89) | 350 | 6.7 | 5.6 | .04 | 460-580 |
| 83 | (90) | 300 | 4.0 | 4.8 | .04 | 450-555 |
| 84 | (91) | 350 | 9.4 | 5.0 | .04 | 460-590 |
| 85 | (92) | 350 | 4.0 | 5.6 | .04 | 460-580 |
| 86 | (93) | 350 | 4.7 | 5.0 | .04 | 460-575 |
| 87 | (94) | 350 | 7.9 | 5.1 | .04 | 460-585 |
| 88 | (95) | 350 | 4.7 | 5.1 | .04 | 480-610 |
| 89 | (96) | 350 | 3.4 | 4.9 | .05 | 460-570 |
| 90 | (98) | 350 | 5.6 | 5.4 | .04 | 460-580 |
| 91 | (99) | 350 | 4.0 | 4.8 | .04 | 450-550 |
| 92 | (101) | 350 | 11.2 | 5.1 | .04 | 480-620 |
| 93 | (102) | 300 | 5.6 | 5.0 | .04 | 460-580 |

TABLE 4-continued

Photographic properties of respective specimens

| Specimen No. | Dye No. | Loading (mg/mol Ag) | S | $\overline{\gamma}$ | $D_{min}$ | Spectral sensitization range (nm) |
|---|---|---|---|---|---|---|
| 94 | (103) | 350 | 11.2 | 5.4 | .04 | 470-620 |
| 95 | (104) | 300 | 6.7 | 4.8 | .04 | 460-590 |
| 96 | (105) | 350 | 7.9 | 4.8 | .04 | 460-585 |
| 97 | (106) | 350 | 7.9 | 5.4 | .04 | 460-580 |
| 98 | (107) | 350 | 7.9 | 5.0 | .04 | 460-580 |
| 99 | (108) | 350 | 5.6 | 5.1 | .04 | 460-600 |
| 100 | (109) | 350 | 11.2 | 5.2 | .04 | 470-630 |
| 101 | (111) | 350 | 7.9 | 5.6 | .04 | 460-580 |
| 102 | (112) | 350 | 5.9 | 5.0 | .04 | 460-570 |
| 103 | (113) | 350 | 7.9 | 4.8 | .04 | 470-610 |
| 104 | (114) | 350 | 7.9 | 5.7 | .04 | 460-590 |
| 105 | (115) | 350 | 4.7 | 5.1 | .04 | 460-580 |
| 106 | (116) | 350 | 4.7 | 4.9 | .04 | 440-550 |
| 107 | (117) | 350 | 5.6 | 4.9 | .04 | 460-575 |
| 108 | (118) | 350 | 7.9 | 5.7 | .04 | 460-590 |
| 109 | (119) | 350 | 6.7 | 5.1 | .04 | 470-600 |
| 110 | (120) | 350 | 7.9 | 5.6 | .04 | 480-620 |

As apparent from Table 4, the dimethine dyes according to this invention are excellent in sensitizing effect, provide the high-contrast photographic characteristics and cause little contamination by the residual dye. Thus, use of the dimethine dyes of this invention allows obtainment of a high-sensitivity and high-contrast direct positive sensitive material. In the tests, no contamination by the residual dye was seen.

EXAMPLE 5

A silver iodobromide emulsion (2% iodine) was prepared by using the control double run method. This crude emulsion was cubic in crystal habit. It was a monodispersed emulsion with average grain size of 0.25μ, and 95 wt% of the grains had the sizes within 30% of the average grain size. This was formed in the following way. After effecting initial growth to 0.16μ, $K_2IrCl_6$ was added in an amount of 50 mg/mole Ag, and after allowing the mixture to stand at 60° C. for 20 minutes, double run was further continued to allow growth to the average particle size of 0.25μ. After precipitation and washing with water, gelatin was added while adjusting pH to 6.5 and PAg to 6.2, and after adding 0.2 mg/mole Ag of thiourea dioxide, the mixture was aged at 60° C. for one hour, followed by further addition of 2 mg/mole Ag of potassium chloroaurate and one-hour fogging at 60° C. Thereafter, PAg and pH were adjusted to 8.5 and 5.0, respectively, and the emulsion was divided into six equal portions, with each portion (specimen) being then added with a dimethine dye according to the prescription of Table 5. The measurements made in the same way as Example 1 gave the results of Table 5 below.

TABLE 5

Photographic characteristics of respective specimens

| Specimen No. | Dye No. | Loading (mg/mol Ag) | S | $\overline{\gamma}$ | $D_{min}$ | Spectral sensitization range (nm) |
|---|---|---|---|---|---|---|
| 111 | Control | — | 1.0 | 5.0 | .05 | — |
| 112 | (57) | 400 | 11.2 | 5.1 | .04 | 460-605 |
| 113 | (58) | 400 | 11.2 | 5.2 | .04 | 460-590 |
| 114 | (91) | 400 | 11.2 | 5.1 | .04 | 460-590 |
| 115 | (103) | 400 | 11.2 | 5.1 | .05 | 470-620 |

TABLE 5-continued

Photographic characteristics of respective specimens

| Specimen No. | Dye No. | Loading (mg/mol Ag) | S | $\bar{\gamma}$ | $D_{min}$ | Spectral sensitization range (nm) |
|---|---|---|---|---|---|---|
| 116 | (109) | 400 | 11.2 | 5.2 | .04 | 470–630 |

As noted from Table 5, the dimethine dyes according to this invention show about 10 times as high sensitization effect as the control and are characterized by the high-contrast photographic characteristics and minimized contamination by the residual dye. It is therefore possible to obtain a high-sensitivity and high-contrast direct positive photographic sensitive material by using the dimethine dyes of this invention. No color stain by the residual dye was noted in the practical tests.

EXAMPLE 6

The emulsion specimens were prepared in the same way as Example 4 except for use of the dyes of Table 6, and the similar measurements of these specimens gave the results shown in Table 6 below.

TABLE 6

Photographic characteristics of respective specimens

| Specimen No. | Dye No. | Loading (mg/mol Ag) | S | $\bar{\gamma}$ | $D_{min}$ | Spectral sensitization range (nm) |
|---|---|---|---|---|---|---|
| 117 | Control | — | 1.0 | 5.0 | .06 | — |
| 118 | (121) | 350 | 2.6 | 5.0 | .05 | 480–600 |
| 119 | (122) | " | 5.5 | 5.0 | .05 | 460–575 |
| 120 | (123) | " | 8.9 | 5.0 | .06 | 480–605 |
| 121 | (124) | " | 10.0 | 5.1 | .05 | 470–580 |
| 122 | (125) | 350 | 8.1 | 5.0 | .05 | 480–590 |
| 123 | (126) | " | 8.9 | 5.6 | .05 | 460–580 |
| 124 | (127) | " | 3.7 | 5.0 | .06 | 450–545 |
| 125 | (129) | " | 8.1 | 5.3 | .05 | 490–605 |
| 126 | (130) | " | 8.1 | 5.8 | .05 | 460–575 |
| 127 | (131) | " | 8.1 | 5.4 | .05 | 480–600 |
| 128 | (132) | " | 8.9 | 5.1 | .05 | 470–600 |
| 129 | (135) | " | 8.1 | 5.3 | .05 | 480–600 |
| 130 | (136) | " | 8.9 | 5.4 | .05 | 470–570 |
| 131 | (139) | " | 7.3 | 5.4 | .05 | 470–580 |
| 132 | (141) | " | 7.3 | 5.4 | .05 | 470–585 |
| 133 | (143) | " | 6.6 | 5.2 | .05 | 460–575 |
| 134 | (145) | " | 8.1 | 5.3 | .05 | 480–580 |
| 135 | (146) | " | 7.3 | 5.2 | .05 | 460–570 |
| 136 | (147) | " | 8.1 | 5.8 | .05 | 460–570 |
| 137 | (150) | " | 10.0 | 5.0 | .06 | 490–600 |
| 138 | (151) | " | 6.6 | 5.0 | .05 | 470–575 |
| 139 | (153) | " | 9.7 | 4.9 | .05 | 480–600 |
| 140 | (154) | " | 5.5 | 5.0 | .05 | 460–570 |
| 141 | (156) | " | 7.3 | 5.0 | .05 | 460–580 |
| 142 | (160) | " | 6.6 | 5.0 | .06 | 460–580 |
| 143 | (162) | " | 9.7 | 5.4 | .06 | 490–630 |
| 144 | (163) | " | 10.0 | 5.0 | .05 | 480–600 |
| 145 | (166) | " | 7.3 | 5.1 | .05 | 460–565 |
| 146 | (168) | " | 7.3 | 5.4 | .05 | 480–600 |
| 147 | (170) | " | 8.9 | 5.1 | .05 | 470–570 |
| 148 | (172) | " | 9.7 | 5.2 | .05 | 470–580 |
| 149 | (173) | " | 8.1 | 5.3 | .05 | 460–575 |
| 150 | (175) | " | 7.3 | 5.2 | .05 | 460–575 |
| 151 | (176) | " | 8.9 | 5.1 | .05 | 470–595 |
| 152 | (178) | " | 4.0 | 5.2 | .05 | 450–525 |
| 153 | (181) | " | 8.1 | 5.3 | .05 | 490–625 |
| 154 | (183) | " | 5.5 | 5.2 | .05 | 460–575 |
| 155 | (185) | " | 8.1 | 5.3 | .05 | 460–570 |

As evident from Table 6, the dimethine dyes according to this invention are excellent in sensitization effect, provide the high-contrast photographic characteristics and are minimized in contamination by the residual dye.

EXAMPLE 7

Emulsion specimens were prepared in the same way as Example 5 except for use of the dyes of Table 7 below, and the results shown in Table 7 were obtained from the measurements of the photographic characteristics of these specimens.

TABLE 7

Photographic characteristics of respective specimens

| Specimen No. | Dye No. | Loading (mg/mol Ag) | S | $\bar{\gamma}$ | $D_{min}$ | Spectral sensitization range (nm) |
|---|---|---|---|---|---|---|
| 156 | Control | — | 1.0 | 5.0 | .06 | — |
| 157 | (186) | 350 | 8.9 | 5.1 | .05 | 480–600 |
| 158 | (187) | " | 6.6 | 5.1 | .05 | 470–585 |
| 159 | (190) | " | 6.6 | 5.1 | .05 | 470–570 |
| 160 | (191) | " | 8.1 | 5.1 | .05 | 460–575 |
| 161 | (194) | " | 8.9 | 5.0 | .05 | 470–595 |
| 162 | (196) | " | 8.9 | 5.0 | .05 | 480–620 |
| 163 | (197) | " | 8.1 | 4.9 | .05 | 470–595 |
| 164 | (199) | " | 8.1 | 5.0 | .05 | 460–570 |
| 165 | (200) | " | 6.6 | 5.1 | .05 | 490–600 |

As apparent from Table 7, the dimethine dyes accordign to this invention have about 6 to 9 times as high sensitization effect as the control, produce the high-contrast photographic characteristics and cause little contamination by residual dye. Therefore, use of the dimethine dyes of this invention gives a high-sensitivity and high-contrast direct positive photographic sensitive material. No contamination by the residual dye was noted in the practical tests.

What is claimed is:

1. A direct positive prefogged silver halide emulsion containing at least one dimethinecyanine dye wherein the 3-position of a pyrazolo[1,5-a]pyridine nucleus is bonded through a dimethine chain to the 1-, 2-, 3- or 4-position of a cyanine hetero ring nucleus, provided that where the bonding is in the 4-position said cyanine nucleus is a quinoline nucleus or a pyridine nucleus and where the bonding is in the 1- or 3-position said cyanine nucleus is an isoquinoline nucleus, said dimethinecyanine dye being present in an amount sufficient to sensitize said emulsion.

2. The direct positive silver halide emulsion as claimed in claim 1, wherein the cyanine hetero ring nucleus is a benzothiazole nucleus, a naphthothiazole nucleus, a benzoselenazole nucleus, an indolenine nucleus, a quinoline nucleus, a quinoxaline nucleus, a 1,8-naphthiridine nucleus, a benzoxazole nucleus or a naphthoxazole nucleus.

3. The direct positive silver halide emulsion as claimed in claim 1, wherein said dimethinecyanine dye is represented by the following general formula:

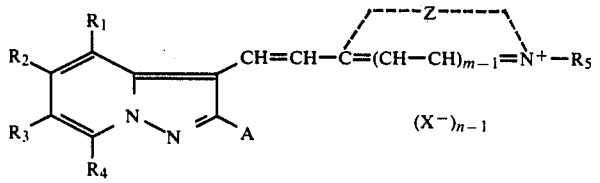

wherein $R_1$ to $R_4$ may be same or different and represent respectively a hydrogen atom or an alkyl group with 1 to 5 carbon atoms, wherein the pyridine ring may be condensed with a benzene ring, $R_5$ represents an alkyl group with 1 to 5 carbon atoms, an alkenyl group or an aryl group, A represents a hydrogen atom, an aryl group, an alkyl group with 1 to 5 carbon atoms or a 5- to 6-membered heterocyclic ring, Z represents the non-metallic atoms necessary to complete a 5- to 6-membered nitrogen-containing heterocyclic ring, $X^-$ represents an acid anion, and m and n represent a number of 1 or 2.

4. The direct positive silver halide emulsion as claimed in claim 1, wherein said emulsion contains an organic desensitizer.

5. The direct positive silver halide emulsion as claimed in claim 4, wherein the organic desensitizer is replaced by Pinakryptol Yellow.

6. The direct positive silver halide emulsion as claimed in claim 1, wherein the silver halide emulsion is a silver iodobromide emulsion.

7. The direct positive prefogged silver halide emulsion as claimed in claim 1, wherein the silver halide emulsion is fogged with a metal compound which is electrically more positive than silver.

8. The direct positive prefogged silver halide emulsion as claimed in claim 1, wherein the silver halide emulsion is fogged with a reducing agent and a metallic compound which is electrically more positive than silver.

9. The direct positive prefogged silver halide emulsion as claimed in claim 7 or claim 8, wherein the metallic compound is a gold compound.

10. The direct positive prefogged silver halide emulsion as claimed in claim 1, wherein the amount of the dimethinecyanine dye is less than $1\times10^{-2}$ moles per mole of silver halide.

* * * * *